US009761080B2

(12) United States Patent
Snow

(10) Patent No.: US 9,761,080 B2
(45) Date of Patent: Sep. 12, 2017

(54) COMMISSIONLESS PAI GOW WITH DEALER QUALIFICATION

(75) Inventor: Roger M. Snow, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 1922 days.

(21) Appl. No.: 12/618,597

(22) Filed: Nov. 13, 2009

(65) Prior Publication Data

US 2011/0115160 A1 May 19, 2011

(51) Int. Cl.
*A63F 1/00* (2006.01)
*G07F 17/32* (2006.01)

(52) U.S. Cl.
CPC ..... *G07F 17/3211* (2013.01); *G07F 17/32* (2013.01); *G07F 17/322* (2013.01)

(58) Field of Classification Search
CPC ..... A63F 1/00
USPC ..... 273/292
See application file for complete search history.

(56) References Cited

U.S. PATENT DOCUMENTS 3,595,987 A 7/1971 Vlahos
4,007,487 A 2/1977 Vlahos
4,100,569 A 7/1978 Vlahos
4,344,085 A 8/1982 Vlahos
4,397,509 A 8/1983 Miller et al.
4,614,342 A 9/1986 Takashima
4,807,884 A 2/1989 Breeding
4,836,553 A 6/1989 Suttle et al.
4,861,041 A 8/1989 Jones et al.
4,948,134 A 8/1990 Suttle et al.
4,995,615 A 2/1991 Cheng
5,087,405 A 2/1992 Maker
5,159,549 A 10/1992 Hallman, Jr. et al.
5,174,579 A 12/1992 Griffiths
5,221,083 A 6/1993 Dote
5,275,411 A 1/1994 Breeding
5,275,416 A 1/1994 Schorr et al.
5,288,077 A 2/1994 Jones
5,364,104 A 11/1994 Jones et al.
(Continued)

OTHER PUBLICATIONS

"Over/Under 13 Blackjack", Product Brochure published by Gaming Concepts, Inc., 1988, 10 pages.
(Continued)

*Primary Examiner* — Aarti B Berdichevsky
*Assistant Examiner* — Dolores Collins
(74) *Attorney, Agent, or Firm* — TraskBritt

(57) ABSTRACT

A pai gow poker game without a house commission is disclosed. After shuffling the cards and determining the order in which players are dealt, the players place wagers on the game outcome. Then, the dealer deals to the player positions and the dealer position. The dealer, either before or after setting the dealer hand, evaluates the dealer cards to determine whether the dealer qualifies. To qualify, the dealer hand must achieve a predetermined rank, such as higher than a king high rank. If the dealer does not qualify, then each player is rewarded at a 1:2 payout rate in relation to his wager. If the dealer does qualify, then the game proceeds according to traditional pai gow play. Payouts to players are made without paying a house commission. Bonus wagers may be placed and rewarded based on bonus events or based on a comparison of the dealt cards to predetermined potential outcomes.

22 Claims, 15 Drawing Sheets

(56) References Cited

U.S. PATENT DOCUMENTS 5,377,973 A 1/1995 Jones et al.
5,397,128 A 3/1995 Hesse et al.
5,454,570 A 10/1995 Karal
5,470,080 A 11/1995 Naka et al.
5,577,731 A 11/1996 Jones
5,580,061 A 12/1996 Kong
5,584,486 A * 12/1996 Franklin ..... 273/292
5,586,766 A 12/1996 Forte et al.
5,586,936 A 12/1996 Bennett et al.
5,597,162 A 1/1997 Franklin
5,632,485 A 5/1997 Woodland et al.
5,636,842 A 6/1997 Cabot et al.
5,653,444 A 8/1997 Dahl
5,673,917 A 10/1997 Vancura
5,685,774 A * 11/1997 Webb ..... 463/13
5,695,189 A 12/1997 Breeding et al.
5,725,216 A 3/1998 Jones
5,743,532 A 4/1998 Lafferty
5,781,647 A 7/1998 Fishbine et al.
5,816,575 A 10/1998 Keller
5,820,460 A 10/1998 Fulton
5,839,730 A 11/1998 Pike
5,851,011 A 12/1998 Lott
5,863,041 A 1/1999 Boylan et al.
5,879,235 A 3/1999 Kaneko et al.
5,931,472 A * 8/1999 Ko ..... 273/292
5,934,675 A 8/1999 Handelman et al.
5,934,998 A 8/1999 Forte et al.
5,976,019 A 11/1999 Ikeda et al.
5,979,897 A 11/1999 Grossman
6,000,699 A 12/1999 Long
6,007,424 A * 12/1999 Evers et al. ..... 463/13
6,012,719 A 1/2000 Webb
6,012,720 A * 1/2000 Webb ..... 273/292
6,019,374 A 2/2000 Breeding
6,068,258 A 5/2000 Breeding et al.
6,070,876 A 6/2000 Ko
6,095,525 A 8/2000 Terminel
6,113,102 A 9/2000 Marks et al.
6,113,103 A 9/2000 Mostashari
6,139,014 A 10/2000 Breeding et al.
6,146,270 A 11/2000 Huard et al.
6,149,154 A 11/2000 Grauzer et al.
6,158,741 A 12/2000 Koeling
6,165,069 A 12/2000 Sines et al.
6,227,969 B1 5/2001 Yoseloff
6,254,096 B1 7/2001 Grauzer et al.
6,267,671 B1 7/2001 Hogan
6,270,078 B1 8/2001 Leone et al.
6,270,404 B2 8/2001 Sines et al.
6,273,424 B1 8/2001 Breeding
6,296,251 B1 10/2001 Webb
6,313,871 B1 11/2001 Schubert
6,322,075 B1 11/2001 DeFranco
6,325,373 B1 12/2001 Breeding et al.
6,334,614 B1 1/2002 Breeding
6,341,778 B1 1/2002 Lee
6,345,823 B1 2/2002 Webb
6,371,867 B1 4/2002 Webb
6,386,973 B1 5/2002 Yoseloff
6,394,456 B1 5/2002 Long
6,394,898 B1 5/2002 Nagao et al.
6,422,564 B1 7/2002 Baranauskas
6,446,972 B1 9/2002 Brunelle
6,450,500 B1 9/2002 Miller
6,460,848 B1 10/2002 Soltys et al.
6,469,747 B1 10/2002 Rai et al.
6,481,718 B2 11/2002 Koeling
6,481,719 B2 11/2002 Webb
6,491,302 B1 12/2002 Boylan et al.
6,517,435 B2 2/2003 Soltys et al.
6,517,436 B2 2/2003 Soltys et al.
6,520,857 B2 2/2003 Soltys et al.
6,523,829 B1 2/2003 Walker et al.
6,527,271 B2 3/2003 Soltys et al.
6,530,836 B2 3/2003 Soltys et al.
6,530,837 B2 3/2003 Soltys et al.
6,533,276 B2 3/2003 Soltys et al.
6,533,662 B2 3/2003 Soltys et al.
6,540,230 B1 4/2003 Walker et al.
6,568,678 B2 5/2003 Breeding et al.
6,579,180 B2 6/2003 Soltys et al.
6,579,181 B2 6/2003 Soltys et al.
6,588,751 B1 7/2003 Grauzer et al.
6,595,857 B2 7/2003 Soltys et al.
6,607,443 B1 8/2003 Miyamoto et al.
6,609,711 B1 8/2003 Campbell
6,638,161 B2 10/2003 Soltys et al.
6,651,982 B2 11/2003 Grauzer et al.
6,651,985 B2 11/2003 Sines et al.
6,652,379 B2 11/2003 Soltys et al.
6,655,684 B2 12/2003 Grauzer et al.
6,658,750 B2 12/2003 Scheibner et al.
6,661,425 B1 12/2003 Hiroaki
6,663,490 B2 12/2003 Soltys et al.
6,698,758 B2 3/2004 Hodge
6,702,289 B1 3/2004 Feola
6,808,173 B2 10/2004 Snow
6,811,153 B1 * 11/2004 Ko ..... 273/292
6,871,855 B1 3/2005 Ko
7,374,170 B2 5/2008 Grauzer et al.
2002/0169013 A1 11/2002 Serizawa et al.
2002/0195773 A1 12/2002 Dunn
2003/0155713 A1 8/2003 Jones et al.
2003/0199316 A1 10/2003 Miyamoto et al.
2004/0003395 A1 1/2004 Srinivas et al.
2004/0224777 A1 11/2004 Smith et al.
2005/0164759 A1 7/2005 Smith et al.
2005/0164762 A1 7/2005 Smith et al.
2006/0279040 A1 12/2006 Downs, III et al.
2007/0256111 A1 11/2007 Medford et al.
2007/0275762 A1 11/2007 Aaltone et al.
2008/0037628 A1 2/2008 Boyce et al.
2008/0303210 A1 12/2008 Grauzer et al.
2011/0115160 A1 * 5/2011 Snow ..... 273/292

OTHER PUBLICATIONS

Gaming Entertainment Inc., Mini Pai Gow™ (Version 2) Dealing Procedures "No Commission", Jan. 2009, 4 pages.
"EZ Pai Gow Poker (with Fully Wild Joker)—Strategy and Odds by The Wizard of Odds", © 1998-2009 Wizard of Odds Consulting, Inc., http://wizardofodds.com/czpaigowpoker, Jun. 30, 2009, 5 pages.

* cited by examiner

COMMISSIONLESS PAI GOW WITH DEALER QUALIFICATION

TECHNICAL FIELD

This invention relates to wagering games and in particular to pai gow commissionless wagering games having a dealer qualification component.

BACKGROUND

Pai gow poker is a popular and well-known poker game that is derived from a Chinese domino game. Traditional pai gow poker is played with a standard 53-card deck with a joker that serves as a wild card and is subject to various rules regarding how the wild card can be played. The rules and method play of traditional pai gow poker are discussed in greater detail in the detailed description below.

While traditional pai gow poker is well received and often played within casinos, it suffers from several drawbacks. One such drawback is that the dealer must collect a commission, which is usually 5% of the player's wager.

As can be appreciated, collecting a 5% commission on a wager is mathematically complex. As a result, the calculation and collection of the commission is time consuming for the dealer, which, in turn, reduces the number of hands played per hour. Slow game play reduces player interest and reduces game profitability for the casino.

One proposed solution has been to eliminate the commission without other game changes, but this solution can alter the game odds and casino hold to make it unprofitable for the casino.

Another proposed solution is a "modified" pai gow poker game wherein the commission is not collected but, in the event the dealer is dealt exactly a queen high in the five-card hand, all wagers are declared a "push." While this solution eliminates the complexities of collecting a commission, it suffers from other drawbacks. First, an exact queen high dealer hand is not a common occurrence during game play, and, therefore, it does little to offset the commissionless play. In addition, players perceive this variation as unfair because an exact queen high hand to the dealer is considered a bad dealer hand and, therefore, good for the player. As such, the players usually want to play the hand since the player has good odds of beating the dealer and receiving a payout. However, just the opposite occurs because this pai gow variation ends the hand as a push and the players get nothing. As can be appreciated, the players perceive that their chance of winning the hand and a payout were taken away.

Another game having commission-free play is set forth in U.S. Pat. No. 6,871,855, titled "Commission-Free Pai Gow." In this game, however, tiles are utilized, not cards. In this game, a player can be rewarded before game play based on the hands the player presents. However, because this player reward before game play is based on the player hands, confusion and slow play can result. For example, if the player's win depends on how the player arranges his hands, the player will more carefully and more slowly present his hand, which, in turn, slows game play. When multiplied over six players at a table, the delay and player confusion can be significant. In addition, this prior art game utilizes tiles, which is a disadvantage for a casino.

As a result, there continues to exist drawbacks in the prior art, and the method and apparatus for commissionless pai gow game play presented below overcomes these drawbacks.

SUMMARY

Disclosed herein is a method and apparatus for playing a commissionless pai gow poker card game with a house advantage. In one embodiment, the method comprises presenting a deck of cards such that the deck of cards comprises 52 physical cards and one physical joker card, for a total of 53 cards. Then, the dealer accepts one or more wagers from one or more players, without collecting a commission, and deals the cards. The dealing comprises moving seven cards to each player to create player cards and seven cards to the dealer to create dealer cards. This method of play then requires each player to arrange his player cards into a five-card player hand and a two-card player hand. The rank of the five-card player hand must be higher than a rank of the two-card player hand. The dealer arranges the dealer cards into a five-card dealer hand and a two-card dealer hand, and the rank of the five-card dealer hand must be higher than a rank of the two-card dealer hand. The dealer typically sets the dealer hand according to a predetermined set of house rules. The dealer then evaluates the cards in the five-card dealer hand to determine whether the five-card dealer hand has a rank of king high or lower.

If the evaluation by the dealer determines that the cards in the five-card dealer hand has a rank of king high or lower, then the dealer automatically pays each wager at a 1:2 payout rate without collecting a commission. Alternatively, if the evaluation of the cards in the five-card dealer hand determines that the five-card dealer hand has a rank higher than king high, then the dealer compares the dealer five-card hand to each player five-card hand and compares the dealer two-card hand to each player two-card hand.

If this comparison determines that the dealer five-card hand has a rank higher than the player five-card hand and the dealer two-card hand has a rank higher than the player two-card hand, then the dealer collects the wagers. If this comparison determines that the dealer five-card hand has a rank lower than the player five-card hand and the dealer two-card hand has a rank lower than the player two-card hand, then the dealer pays the wagers at a rate of 1:1 without collecting a commission. If the comparison determines that one of the dealer's hands has a rank higher than a corresponding player's hand and the other of the dealer's hands has a rank lower than a corresponding player's hand, then the dealer declares the game a push, and the dealer returns the wager to the player without collecting a commission.

In one embodiment, this method further comprises accepting a bonus event wager from one or more players and evaluating a bonus event. The bonus event comprises an outcome of one or more dealt cards. The outcome is evaluated, and then the dealer collects the bonus event wagers, if the bonus event has a losing outcome, and pays bonus event wagers, if the bonus event has a winning outcome.

Also disclosed is a method for playing a commissionless pai gow poker card game with a house advantage. This method comprises presenting a deck of physical cards such that the cards comprise at least a deck of 52 physical cards. As part of play, the dealer or house accepts one or more wagers from one or more players without collecting a commission and deals cards to the players and dealer. In this embodiment the dealing comprises dealing at least six cards to each player or player position to create player cards and at least six cards to the dealer to create dealer cards. This method of play requires each player to arrange his or her player cards into a high player hand and a low player hand. The rank of the high player hand must be higher than a rank of the low player hand. Likewise, the dealer arranges the dealer cards into a high dealer hand and a low dealer hand such that the rank of the high dealer hand is higher than a rank of the low dealer hand. The dealer typically sets the dealer hand according to a house way.

The dealer evaluates the dealer cards before or after the arranging of the dealer cards to determine whether the dealer has a qualifying rank. If the dealer does not have a qualifying rank, then the dealer pays each wager at a payout rate greater than 1:10 and less than 1:1 without collecting a commission. If the dealer does have a qualifying rank, then the dealer compares the dealer high hand to each player high hand and compares the dealer low hand to each player low hand.

If the comparison determines that the dealer high hand has a rank higher than the player high hand and the dealer low hand has a rank higher than the player low hand, then the dealer collects the wagers. Alternatively, if the comparison determines that the dealer high hand has a rank lower than the player high hand and the dealer low hand has a rank lower than the player low hand, then the dealer pays the wagers at a rate at least 1:1 without collecting a commission.

Also disclosed is a method of playing a wagering game at a gaming table having electronic components and a player interface, the method comprising accepting player credit wagers from a player on a player interface that is built into or is part of the gaming table. In this embodiment, each player position comprises a player interface. Then, physical cards are dealt from at least a standard deck of 52 cards, plus a joker, to one or more players and the dealer. These cards become assigned player cards and dealer cards. The method of play then requires the players to arrange their assigned player cards into pai gow hands such that the pai gow hands comprise a player high hand and a player low hand. Then the dealer arranges the dealer assigned cards into pai gow hands, namely a dealer high hand and a dealer low hand.

Next, the dealer or the game system evaluates the dealer cards to determine whether the dealer cards exceed a qualifying rank. If the evaluating step determines the dealer does not have a qualifying rank, then the system electronically adds player credits to the player interface at a payout rate of 1:2 to reward the players without the dealer collecting a commission. If the evaluating step determines the dealer pai gow hands have a qualifying rank, then this game method compares the dealer high hand to each player high hand and compares the dealer low hand to each player low hand.

If this comparison determines that the dealer high hand has a rank higher than a player high hand and the dealer low hand has a rank higher than a player low hand, then the player's bet is lost, and the system or dealer removes the player credit wagers from the player interface without collecting a commission. Alternatively, if the comparison determines that the dealer high hand has a rank lower than a player high hand and the dealer low hand has a rank lower than a player low hand, then the player wins on the wager, and the system electronically adds credits to the player interface at a rate at least 1:1 without the dealer collecting a commission.

In one embodiment, this method further comprises detecting the cards dealt to each player and the dealer from a card reader to create card data and evaluating whether the dealer cards exceed a qualifying rank. This method further comprises processing the card data regarding the dealer cards on a processor or controller to determine whether the dealer cards exceed a qualifying rank. The electronic interface may comprise a display and associated user interface or a touch display.

A method for presenting a commissionless pai gow poker game on a multiplayer electronic gaming platform is also disclosed. This embodiment comprises accepting credit wagers from players to participate in a pai gow poker game. The acceptance of credit wagers comprises accepting player input into the electronic gaming platform to create wagered credits from a player position. The method includes dealing virtual cards to the players and the dealer to create dealer cards for the dealer and player cards for each player such that dealing comprises generating one or more random numbers and displaying corresponding cards on an electronic display. Thereafter, the player cards are arranged, or the system accepts input from the players to arrange the player cards, to create player pai gow hands. The system arranges the dealer cards to create dealer pai gow hands.

This method of play evaluates the displayed dealer cards to determine whether the dealer cards comprise a qualifying rank of higher than king high. If the dealer cards do not comprise a qualifying rank, then the dealer adds credits at a rate of 1:2 to each player position at which a credit wager was made and ends the poker game. If, however, the dealer cards do comprise a qualifying rank, then the dealer's pai gow hands are compared against each player's pai gow hands to determine winning players and losing players. Wagers are resolved by retaining the credit wagers for losing players and adding credits for winning players at the winning players' player positions.

In one embodiment, this method further comprises generating a winning notification at each player position in response to the dealer cards not qualifying and at each winning player's player position in response to the determination of a winning player. It is contemplated that the generating of one or more random numbers and evaluating the displayed dealer's cards is performed by a computer processor.

Other systems, methods, features, and advantages of the invention will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION

Figure 1:
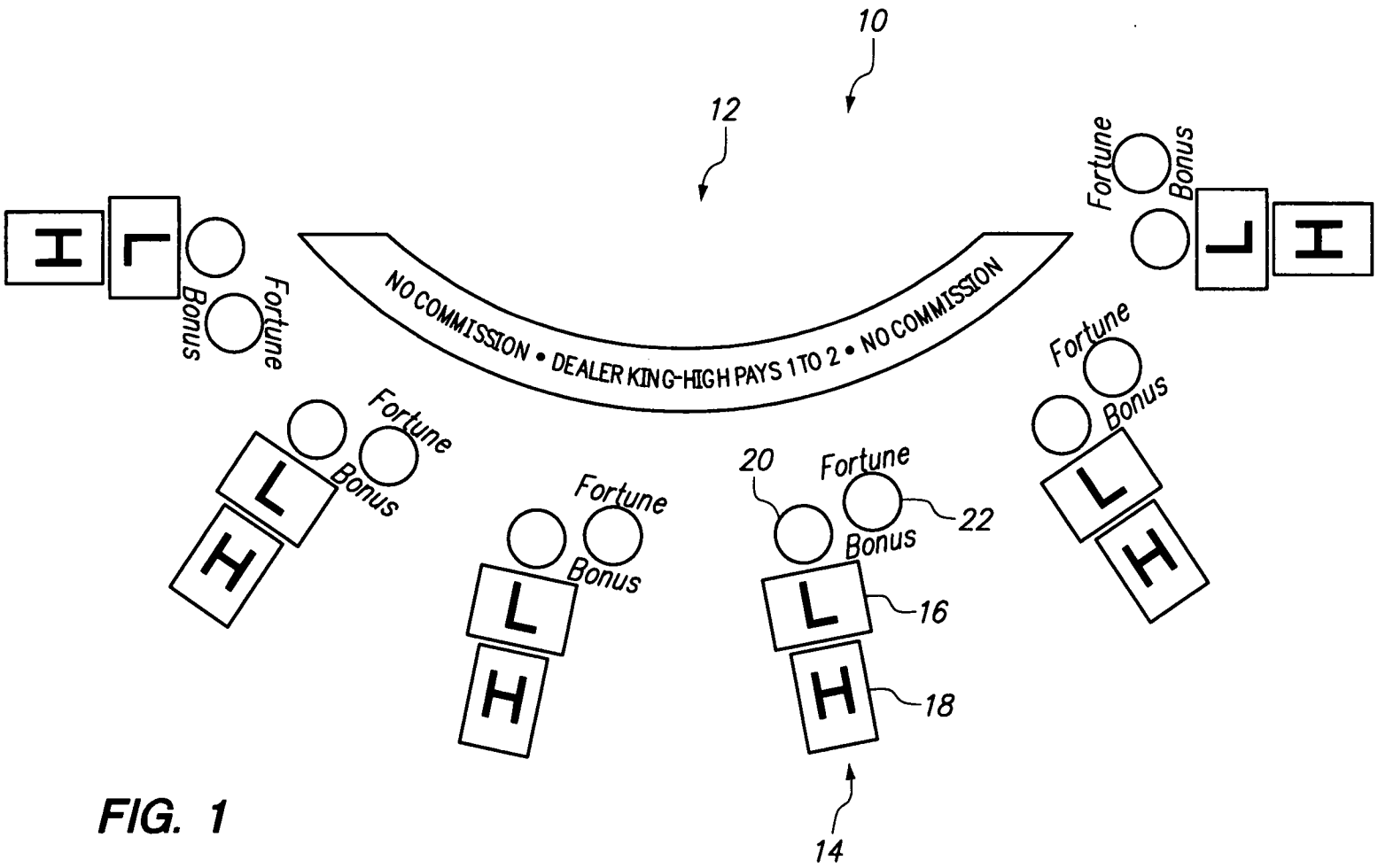
FIG. 1 illustrates an exemplary gaming table or game presentation area layout.

The commissionless game of pai gow is now described in connection with the improvements. Traditional pai gow poker utilizes a deck of 52 cards, plus a joker, i.e., a total of 53 cards. The joker serves as a wild card under limited circumstances. Game play is player against a dealer. Prior to play, the cards are shuffled to ensure fair play, and the dealer determines to which player cards will be dealt first. Numerous different options are implemented to determine to which player cards are dealt first. Dice may be utilized or a random number generator may be used to randomly select the first player to receive cards. It is contemplated that any method of randomly selecting a player can be adopted for use.

Then, players wager on the base game. In addition, if the base game is supplemented by a bonus event, a player may place a bonus wager on the bonus event. The bonus event may be a separate random event or part of the base game.

After shuffling, deal order determination, and wagering, the dealer deals the cards by providing seven cards to each player, or player position, and to the dealer. In other embodiments, a different number of cards may be dealt. These assigned cards are referred to as the dealer cards and the player cards. In one embodiment, the dealer deals cards to each player position at the table, regardless of whether a player is at the player position. Hands dealt to a player position that is not occupied by a player are referred to as "dragon hands" and may be played by other players at the table, subject to the particular rules of the casino.

The dealer and players arrange their cards into a back hand and a front hand. The back hand comprises more cards than the front hand and typically must have a higher rank than the front hand. When dealt seven cards, the cards are arranged into a five-card hand and a two-card hand, such that the five-card "back" hand has a higher rank than the two-card "front" hand.

The rank of the five-card hand mirrors traditional poker hand ranks in the following order: straight flush, four-of-a-kind, full house, flush, straight, three-of-a-kind, two pair, one pair, high cards based on rank. The two-card hand also adopts traditional poker hand ranking, but with only two cards, and pairs rank higher than non-paired cards. Straights and flushes are not offered in the two-card hand. Jokers are wild cards and may be part of either hand. Although not required for the various embodiments of this game, jokers are treated as aces unless structured as a face card in a flush or a straight.

According to the order of play, each player arranges his player cards into a five-card player hand and a two-card player hand. Although subject to casino rules, the players have discretion regarding how to place the player cards within the hands, but the five-card hand must have a higher rank than the two-card hand. Failure by the player to meet this requirement results in a "foul," thereby causing the player to either have the dealer set his hand or forfeit his wager, subject to casino rules.

The dealer then arranges the dealer cards into a five-card dealer hand and a two-card dealer hand. The dealer cards are arranged according to a house way, which may vary according to casino rules. In all house way variations, the five-card hand is higher than the two-card hand. These hands of the dealer and the player may be referred to as pai gow hands. An exemplary set of "house way" rules for setting pai gow dealer hands is described below.

A bonus event may occur either before or after the arranging of the cards by the player and dealer. The bonus event may be based on the dealt cards or another event. An exemplary bonus event is described in detail in U.S. Pat. No. 5,863,041, the disclosure of which is hereby incorporated by reference.

Before moving to the base game, the dealer cards, the dealer five-card hand, or dealer two-card hand undergo a qualification step. In one embodiment, the dealer five-card hand must have a rank higher than king high for the game to progress to base game play. If the dealer hand does not qualify, for example, if the dealer five-card hand has a rank of king high or lower, then the dealer pays all wagers at a payout rate greater than a push, but less than 1:1. In one embodiment, players are paid at a 1:2 payout rate. Thus, a wager of ten dollars would result in the player keeping the ten dollars and being paid five dollars. Then the bonus event aspect of the game, if so configured, is played out. Since the five-card hand must hold the highest ranking cards, the entire group of seven dealer cards could instead be evaluated to determine whether the dealer qualifies to play. The outcome would be the same.

Alternatively, if the dealer five-card hand has a rank of higher than king high, then the game progresses to the base game. The base game occurs by comparing the five-card dealer hand to each player's five-card hand and comparing the dealer's two-card hand to each player's two-card hand. Dragon hands also undergo this comparison if being played by a player. The winning five-card hand is the hand that has the higher poker rank, and the winning two-card hand is the two-card hand with the higher rank, with a pair beating unpaired cards, and unpaired cards having the following rank in descending order: ace, king, queen, jack, ten, nine, eight, seven, six, five, four, three, two.

The comparison of the hands determines whether the dealer wins the game, the player wins the game, or the game is a push, for each particular player. If the dealer's five-card hand is higher than the player's five-card hand and the dealer's two-card hand is higher than the player's two-card hand, then the dealer wins and collects the base game wagers.

If the player's five-card hand is higher than the dealer's five-card hand and the player's two-card hand is higher than the dealer's two-card hand, then the player is the winner and the dealer must provide the player a payout. The payout may be determined by the casino rules, but in one embodiment the payout is a 1:1 payout. Hence, if the player wagers ten dollars, then the player keeps his ten dollars and is paid an additional ten dollars.

If one of the dealer's hands has a higher rank than the corresponding player hand, but one of the dealer's hands has a lower rank than the corresponding player hand, then the game is a push as to that player. For example, if the dealer's five-card hand has a higher rank than the player's five-card hand, but the dealer's two-card hand has a lower rank than the player's two-card hand, then the game is declared a push and the bet is returned to the player.

Thereafter, bonus wagers based on the dealt cards or a bonus event are settled.

FIG. 1 illustrates an exemplary table layout for game play of the game described herein. This is but one possible game table layout, and other layouts may be created without departing from the scope of the claims that follow. It is also contemplated that this layout may be utilized in environments other than on a live game table, such as electronic displays, monitors, computer screens, game boards, hand-held devices, or other surfaces to facilitate game play.

As shown in FIG. 1, a table surface 10 may comprise any material or construction. In one configuration, the table surface 10 is a traditional felt cover table having three or more legs supporting a solid top felt covered surface. The felt has imprinted or screened graphics. In this embodiment, a dealer position 12 opposes one or more player positions 14. The player position 14 includes a low hand location 16 and a high hand location 18. The high hand location 18 may be sized to accommodate the five-card hand. During game play, the player sets his high hand at the high hand location 18 and sets his low hand at the low hand location 16. The high hand may also be referred to as a "back hand" (from the dealer's perspective) or a five-card hand. The low hand may also be referred to as a "front hand" (from the dealer's perspective) or a two-card hand.

Also presented on the game layout (i.e., the table surface 10) is a base game wager spot 20 and a bonus wager spot 22. These spots 20, 22 are located between the player card locations 16, 18 and the dealer position 12. As part of wagering during the base game and on the bonus game or event, the player places wagers on the base game wager spot 20 and the bonus wager spot 22. Wagers may be placed using tokens, chips, money, or as described below, credits.

In other embodiments, the arrangement of the elements may be varied to suit the particular casino rules or graphical preferences. Any such change to the table layout would not cause the game to depart from the claims that follow.

Exemplary House Way

In this discussion, one exemplary house way card arrangement for the dealer hand is presented. The "front hand" refers to the two-card hand or the low hand, and the "back hand" refers to the five-card hand or the high hand. If the dealer cards have:

- No pair, then place the highest card in the back hand and the next two highest cards in the front hand;
- One pair, then place the pair in the back hand and the next two highest cards in the front hand;
- Two pair, then use the following groups to determine how to play a two pair:
  - 2 through 6: Low pair
  - 7 through 10: Medium pair
  - Jack through king: High pair
    - Low pair and low pair, then split unless holding a king or better, then play two pair in the back hand;
    - Low pair and medium pair, then split unless holding a king or better, then play two pair in the back hand;
    - Low pair and high pair, then split unless holding an ace, then play two pair in the back hand;
    - Medium pair and medium pair, then split unless holding an ace, then play two pair in the back hand;
    - Medium pair and high pair, then always split between front hand and back hand;
    - High pair and high pair, then always split between front hand and back hand;
    - Pair of aces and any other pair, then always split between front hand and back hand.
- Three pair, then always play highest pair in the front hand;
- Three-of-a-kind, then always play three-of-a-kind in back hand unless they are aces, then play a pair of aces in back hand and one ace in the front hand;
- Three-of-a-kind twice, then always play highest pair in the front hand;
- Straights, flushes, straight flushes, and royal flush:
  - With no pair, then when choosing whether to play a straight, flush, or straight flush, play the category that will allow the highest two cards in the front hand;
  - With the 6th or 7th card, then play the lower straight or flush in the back hand to place the highest cards in the front hand;
  - With one pair, then play the pair in the front hand only if a straight, flush, or straight flush can be played in the back hand;
  - With two pair, then use the two-pair rule;
  - With three pair, then use the three-pair rule;
  - With three-of-a-kind, then play the pair in the front hand;
  - With full house, then use the full house rule;
- Full house, then always split unless the pair is twos and you have an ace and a king to play in the front hand;
- Full house with three-of-a-kind and two pairs, then play the highest pair in the front hand;
- Full house with three-of-a-kind twice, then always play the highest pair in the front hand;
- Four-of-a-kind, then play according to the rank of the four-of-a-kind;
- 2 through 6, then always keep together;
- 7 through 10, then split unless a king or better can be played in the front hand;
- Jack through king, then split unless an ace can be played in the front hand;
- Aces, then always split;
  - Four-of-a-kind and a pair, then play pair in the front hand;
  - Four-of-a-kind and three-of-a-kind, then play the pair in the front hand from the three-of-a-kind;
  - Five aces; then split the aces and play three aces in the back hand and two aces in the front hand unless you have a pair of kings, then play five aces in the back hand and kings in the front hand.

This is but one example house way embodiment, and it is contemplated that one of ordinary skill in the art may utilize other house way card arrangement rules.

Figure 2:
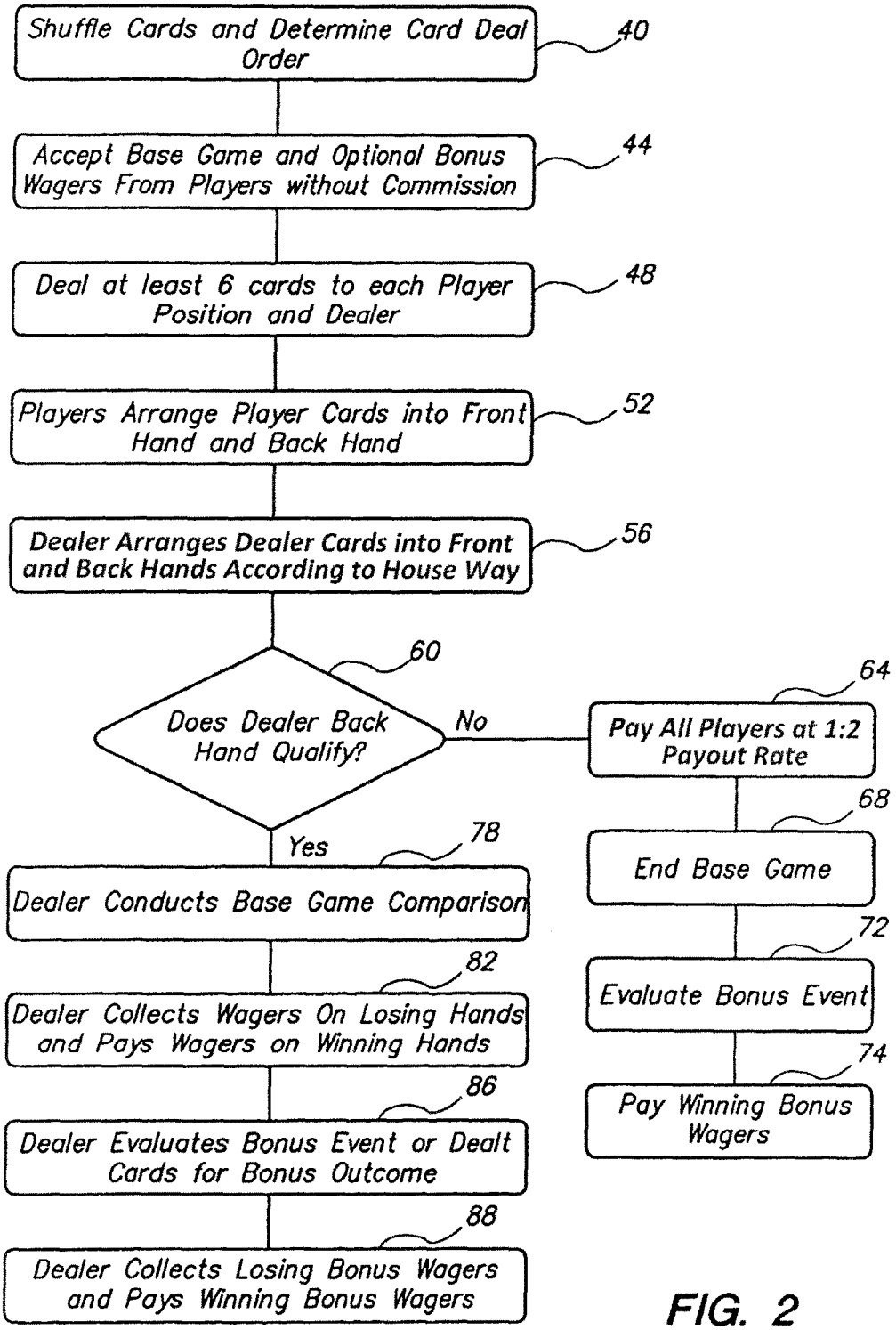
FIG. 2 illustrates a flow diagram of an exemplary method of game play.

FIG. 2 illustrates an operational flow diagram of an exemplary method of play utilizing the embodiment disclosed herein. This is but one possible method of play. In this example embodiment, at a step 40 the casino or dealer, referred to collectively as "the dealer," shuffles the cards and determines the dealing order for the cards. A standard single deck of 52 cards is utilized, with the addition of a joker card, for a total of 53 cards.

Any type of shuffling may occur including use of pre-shuffled decks, manual shuffling, or an automatic shuffler. Automatic shufflers have the advantage of providing rapid and truly random shuffling while minimizing delay between games. This, in turn, increases game fairness and the number of hands dealt per hour. One example of such a shuffler is set forth in U.S. Patent Publication Number 2008/0303210, which is incorporated by reference in its entirety herein. Shufflers of this nature are available from Shuffle Master, Inc., located in Las Vegas, Nev.

Determination of to which player to deal cards first may likewise occur based on any known or future developed method for randomly selecting a player or player position from a group of players. This random order may be established using dice, a draw of cards, a stand-alone random number generator, or a random number generator built into a shuffler. The shuffler disclosed in U.S. Pat. No. 5,275,411, available from Shuffle Master, a Scientific Games Corporation brand, includes a random number generator with display.

At a step 44, the dealer accepts wagers from the players for the base game and one or more optional bonus wagers. The wagers may be placed in any manner including placement of chips or tokens having assigned monetary value on the table surface. In other embodiments, other methods and types of wagering are contemplated. If a dragon hand is dealt, then the dealer may accept wagers from one or more players on the dragon hand. It is contemplated that, in one embodiment, these wagers occur, as would any possible payouts, without collection of a commission by the dealer. Hence, commissionless play may occur, thereby increasing the number of hands per hour, freeing the dealer from complex commission amount calculation involving fractions of a dollar, and allowing the player to avoid having to "pay to play."

At a step 48, the dealer deals at least six cards to the dealer position and to each player position or player depending on the house rules. If cards are dealt to unoccupied player positions, then such hands are referred to as "dragon hands" and may be played by a player at the table, in addition to that player's primary hand. In one embodiment, each player position or player is dealt seven cards. For purposes of the following discussion, seven cards are dealt to each player position and to the dealer position. These cards are referred to as the player cards and the dealer cards.

At a step 52, the players arrange their player cards into a high hand, also referred to as a back hand or five-card hand, and a low hand, also referred to as a front hand or two-card hand. The high hand contains five cards while the low hand contains two cards. The player's five-card hand must have a higher rank than the player's two-card hand. If the player arranges his hands to have the two-card hand with a higher rank than the five-card hand, a player foul is declared and, depending on house rules, the player may forfeit his wager or the dealer may set the hand according to the house way. The player may optionally request the dealer's assistance in setting his hands.

At a step 56, the dealer arranges the dealer's cards into a five-card hand and a two-card hand. The dealer's cards are arranged according to a house way, and different house way schemes may be utilized depending on the casino.

Next, at a decision step 60, the dealer determines whether the dealer's back hand, i.e., five-card hand, qualifies. It is also contemplated that this decision step 60 may occur prior to the players and/or dealer setting their cards into high hands and low hands, which would reduce potentially unnecessary game steps and increase the number of games played per hour. In various different embodiments, the qualifying requirements for the dealer hand may change. In one embodiment, the dealer qualifying hand is higher than a king high hand. In other embodiments, the dealer qualifying hand may be an ace high, a queen high, a jack high, a pair, or other hand. In this embodiment, if the dealer's five-card hand is king high or lower rank, then the dealer hand does not qualify.

If, at decision step 60, the dealer hand does not qualify, then the method of play advances to a step 64. At step 64, the dealer automatically pays all player wagers on the base game at a pay rate of 1:2 payout. Then, at a step 68, the base game ends, and the player hands do not undergo a comparison with the dealer hand.

At a step 72, the dealer may evaluate the bonus event. Any type bonus event may optionally be paired with this game to provide additional wagering opportunities. It is also contemplated that, in one embodiment, the bonus event comprises a FORTUNE PAI GOW BONUS™ as offered by Shuffle Master, of Las Vegas, Nev., now a Scientific Games Corporation brand. One such embodiment of the FORTUNE PAI GOW BONUS™ feature is described in U.S. Pat. No. 5,863,041, titled "Pai Gow Poker with Auxiliary Game," which is incorporated in its entirety herein. The FORTUNE PAI GOW BONUS™ is an optional bonus wager that considers the best hand possible among the player's seven cards. Players may bet any amount on the bonus within table limits, and, if at least a certain amount is bet, then the player is qualified for ENVY BONUS™ payouts. Then, after the cards are placed in pai gow hands, the dealer evaluates the player's hand against predetermined pay tables for hand ranks to determine whether a player wins a pay table based on a fixed or progressive bonus. In addition, if anyone at the table receives a four-of-a-kind or higher, then every other player who placed a sufficient bonus wager wins the ENVY BONUS™, which is an additional or separate payout. In one embodiment, the player must wager five or more dollars to qualify for the ENVY BONUS™. In one embodiment, the player who had the four-of-a-kind or higher does not win the ENVY BONUS™ payout (e.g., at step 74).

Another or alternative exemplary bonus event that may be incorporated with the base game described herein is a progressive bonus event. One exemplary progressive bonus event and bonus wager is described in U.S. Pat. No. 5,364,104, titled "Apparatus for Progressive Jackpot Gaming." This reference is incorporated by reference in its entirety. The progressive payout may be a full progressive payout, a half progressive payout, or a quarter progressive payout. In addition, it is contemplated that the bonus payout (e.g., at step 74) may be based on a pay table. The progressive payout may be won based on a player's hand rank or based on a mystery award. The progressive pay table, in addition to a progressive payout or payouts, may include fixed payouts, odds payouts, and combinations thereof.

It is also contemplated that the bonus event or bonus payout may be a BAD BEAT BONUS™. The BAD BEAT BONUS™ is won when a player, with a predetermined hand or higher, loses the base game. In such an event, the player is rewarded with a bonus payout (e.g., at step 74), even after losing the base game with a sufficiently high hand rank that would usually be a winning hand.

Alternatively, if, at decision step 60, the dealer's five-card hand does qualify, then the operation advances to a step 78. At step 78, the dealer conducts a base game comparison according to pai gow rules as described herein. The comparison of the hands determines whether the dealer wins the game, the player wins the game, or the base game is a push, for each particular player. If a dealer's five-card hand is higher than the player's five-card hand and the dealer's two-card hand is higher than the player's two-card hand, then the dealer wins and collects the base game wagers.

If the player's five-card hand is higher than the dealer's five-card hand and the player's two-card hand is higher than the dealer's two-card hand, then the player is the winner and the dealer must provide the player a payout. The payout may be determined by the casino rules, but, in one embodiment, the payout is a one-to-one payout. Hence, if the player wagers ten dollars, then the player keeps the ten dollars and is paid an additional ten dollars.

If one of the dealer's hands has a higher rank than the corresponding player hand, but one of the dealer's hands has a lower rank than the corresponding player hand, then the game is a push as to that player. For example, if the dealer's five-card hand has a higher rank than the player's five-card hand, but the dealer's two-card hand has a lower rank than the player's two-card hand, then the game is declared a push.

In one embodiment, tie hands are considered won by the dealer. In one embodiment, tie hands are considered won by the player.

At a step 82, the dealer collects wagers on losing player hands and pays wagers on winning player hands. Dragon hands played by a player are likewise evaluated. At a step 86, the dealer evaluates the bonus event or the dealt cards for the bonus outcome. As set forth above, any bonus event or outcome may be paired with the base game described herein. At a step 88, the dealer collects losing bonus event wagers and pays winning bonus event wagers. Thereafter, a new game may begin after cards are collected and new players are accepted at the table.

It is further contemplated and disclosed that the game described above may be played on, or in connection with, one or more electronic gaming platforms or electronically supplemented gaming tables. Example embodiments of such systems are described below. One of ordinary skill in the art can implement the commissionless pai gow game on these systems based on the following disclosure.

Table Master Gaming Systems

The games of the present invention may be implemented as live table games, as television or cable game show games, on video poker gaming machine platforms, in hand-held games for play, in multiple player interactive wagering platform games (with kiosk formats, single player screens, community screens, and/or banks of seats for players with a common dealer screen), in cell phone games, in games downloadable from the internet, as parlor games, as games executed on personal computers, as games played on internet gaming websites, in palm pilots, in play stations, and the like. Each of the above game formats is contemplated by the present invention. Examples of known multiple player platforms are described in U.S. Pat. No. 6,607,443 and in U.S. Publication Number 2005/0164759A1. The contents of these two disclosures are hereby incorporated by reference in their entireties.

A gaming system that can be used to practice the method of the present invention comprises a table and a dealer "virtual" video display system positioned for view by players seated at the table. The table may seat at least two players up to the amount of players that can be configured about the table and have a view of the dealer video display system. Typically, each gaming system will have at least four player available positions, with space determinations considered as to whether there would be four, five, six, or seven player positions. It is possible to have a completely circular dealer display (e.g., holographic display in a cylindrical centerpiece) and have players distributed around the entire periphery, but this is too dissimilar to standard play arrangements and could slow the game down, as play should approximate that of a live game, with players playing in sequence. A surface of the table includes a communal display surface for showing all player hands, community cards, dealer hands, and any other cards used to play the game for any purpose, and, chips or other wagering designations. The table surface may include separate push button and or touchscreen player controls, with or without other display features specific to the individual player. For example, the individual player screen may show a running history of wins/losses, credits available, credits bet, and play options. A majority of the table surface comprises a video monitor in one example of the invention. Where there are no touchscreen controls, the table surface may include player control panels at each player station near the communal display surface.

The use of a large communal display surface offers some significant advantages in simulating or recreating a standard card table surface. Cards may be readily viewed by other players at a table, which is standard in table games and adds to player enjoyment. Individual monitors, especially where slanted toward the individual players, make such table-wide card reading difficult. The use of the full screen (continuous) communal display also allows for better animation to be provided, such as displaying virtual images of cards moving to the player and "virtual" chips being placed on the table when wagers are indicated. For purposes of this disclosure, the term "virtual" means a graphical video representation of a real object or person, such as a dealer, cards, and chips, for example.

The individual player positions preferably have a separate intelligence at each player position that accepts player input and communicates directly with a game engine (main game computer or processor). The intelligence is preferably an intelligent board that can process information. For purposes of this disclosure, the term "intelligent" refers to the ability to execute code, either provided in the form of software or hardware or a combination of software and hardware circuits. Such processing may at least comprise some of signal converting (e.g., signals from player card readers, credit deposits, currency readers, coin readers, touchscreen signals, ticket readers/printers, and control panel signals) into a signal that can be included in an information packet and interpreted by the main game computer when the signal is sent. Communication between the intelligence at each player position is direct to the main game computer and may be by self-initiated signal sending, sequenced polling by the main game computer (e.g., each position communicates directly to the main game computer in turn), timed communication, or any other order of communication that is direct between the intelligence and the main game computer.

One preferred form of communication between the main game computer and player station computers is by means of self-initiated signal sending. There is essentially a single main game computer that contains video display controls and programs for both the dealer display and the table top display, audio controls and programs, game rules (including storage of multiple games if intended to be available on the machine), a random number generator, graphical images, game sequence controls, security systems, wager accounting programs, external signaling and audit functions, and the like. In other forms of the invention, the above functions are divided between a main processor and one or more additional processors. The intelligence at each player position speeds up the performance of all aspects of the game by being able to communicate directly with the main game computer and being able to process information at the player position rather than merely forwarding the information in raw form to the main game computer. Processing player information at the player positions frees up resources for use by the main processor or processors.

A card game system may also include a suitable data and control processing subsystem that is largely contained within a main control module supported beneath the tabletop. The control and data processing subsystem includes a suitable power supply for converting alternating current from the power main as controlled by a main power switch. The power supply transforms the alternating line current to a suitable voltage and to a direct current supply. Power is supplied to a power distribution and sensor/activity electronics control circuit. Commercially available power switching and control circuits may be provided in the form of a circuit board that is detachable and plugs into a board receptacle of a computer motherboard or an expansion slot board receptacle. A main game controller motherboard may include a central microprocessor and related components well known in the industry as computers using Intel Corp., Santa Clara, Calif., brand PENTIUM® microprocessors and related memory or intelligence from any other manufacturing source. A variety of different configurations and types of memory devices can be connected to the motherboard, as is well known in the art. Of particular interest is the inclusion of two flat panel video display control boards connected in expansion slots of the motherboard. Display control boards are each capable of controlling the images displayed for the dealer video display and for the common display area. More specifically, the display control boards are connected to player bet interface circuits for the player stations. This arrangement allows the display control boards to provide necessary image display data to the display electronic drive circuits associated with the dealing event program displays and the dealer display.

The motherboard and/or the individual player intelligent boards also include a serial port that allows stored data to be downloaded from the motherboard to a central casino computer or other additional storage device. In one example, each player board communicates directly with the casino computer system. This allows card game action data to be analyzed in various ways using added detail, or by providing integration with data from multiple tables so that cheating schemes can be identified and eliminated and player tracking can be maintained. Player performance and/or skill can be tracked at one table or as a compilation from gaming at multiple tables, as by using BLOODHOUND™ security software marketed by Shuffle Master, Inc., which may be incorporated into this automated gaming system. Additionally, player hand analysis can be performed. The motherboard and/or individual player intelligent boards may also have a keyboard connection port that can be used to connect a larger format keyboard to the system to facilitate programming and servicing of the system.

Although the preferred system shown does not require features illustrated for receiving automated player identification information, such features can alternatively be provided. Card readers, such as those used with credit cards, player cards, or other identification code reading devices, can be added in the system to allow or require player identification in connection with play of the card game and associated recording of game action by one of the processors. Such a user identification interface, for example, a card reader located at each player station, can be implemented in the form of a variety of magnetic card readers commercially available for reading user-specific identification information. The user-specific information can be provided on specially constructed magnetic cards issued by a casino, or magnetically coded credit cards or debit cards frequently used with national credit organizations such as VISA®, MASTERCARD®, AMERICAN EXPRESS®, casino player card registry, banks, and other institutions. The information could also be provided on other writable media, such as an RFID chip or card with writable memory, or bar coding, as just a few examples.

Alternatively, it is possible to use so-called "smart cards" to provide added processing or data storage functions in addition to mere identification data. For example, the user identification could include coding for available credit amounts purchased from a casino. As a further example, the identification card or other user-specific instrument may include specially coded data indicating security information that would allow accessing or identifying stored security information that must be confirmed by the user after scanning the user identification card through a card reader. Such security information might include such things as file access numbers that allow the central processor to access a stored security clearance code, which the user must indicate using input options provided on displays using touchscreen inputs. A still further possibility is to have participant identification using a fingerprint image, eye blood vessel image reader, or other suitable biological information to confirm identity of the user that can be built into the table. Still further, it is possible to provide such participant identification information by having the pit personnel manually code in the information in response to the player indicating his or her code name or real name. Such additional identification could also be used to confirm credit use of a smart card or transponder. All or part of the functions dedicated to a particular player station are controlled by the player station intelligence in one form of the invention. Additionally, each player station intelligence may be in communication with a casino accounting system.

It should also be understood that the player display screens can alternatively be provided with suitable display cowlings or covers that can be used to shield display of card images from viewing by anyone other than the player, in games where that is desirable. This shielding can also be effected by having light-orientation elements in the panel, and some of these light-orientation elements are electronically controllable. This type of shielding could also be used in controlling visual access to the main game play screen. In this manner, the processor can allow general viewing of cards, in games where that is desirable or tolerated, and then alter the screen where desired. These types of features can be provided by nanometer, micrometer, or other small particulate or flake elements within a panel on the viewing area that are reoriented by signals from the processor. Alternatively, liquid crystal or photo chromatic displays can be used to create a screening effect that would allow only viewers at specific angles of view from the screen area to view the images of cards. Such an alternative construction may be desired in systems designed for card games different from blackjack, where some or all of the player or dealer cards are not presented for viewing by other participants or onlookers. Such display covers or cowlings can be in various shapes and configurations as needed to prevent viewing access. It may alternatively be acceptable to use a player-controlled switch that allows the display to be momentarily viewed and then turned off. The display can be shielded using a cover or merely by using the player's hands. Still further, it is possible to use a touchscreen display that would be controlled by touch to turn on and turn off. Similar shielding can be used to prevent others from viewing the display.

A review of the figures will assist in a further understanding of the invention.

Figure 3:
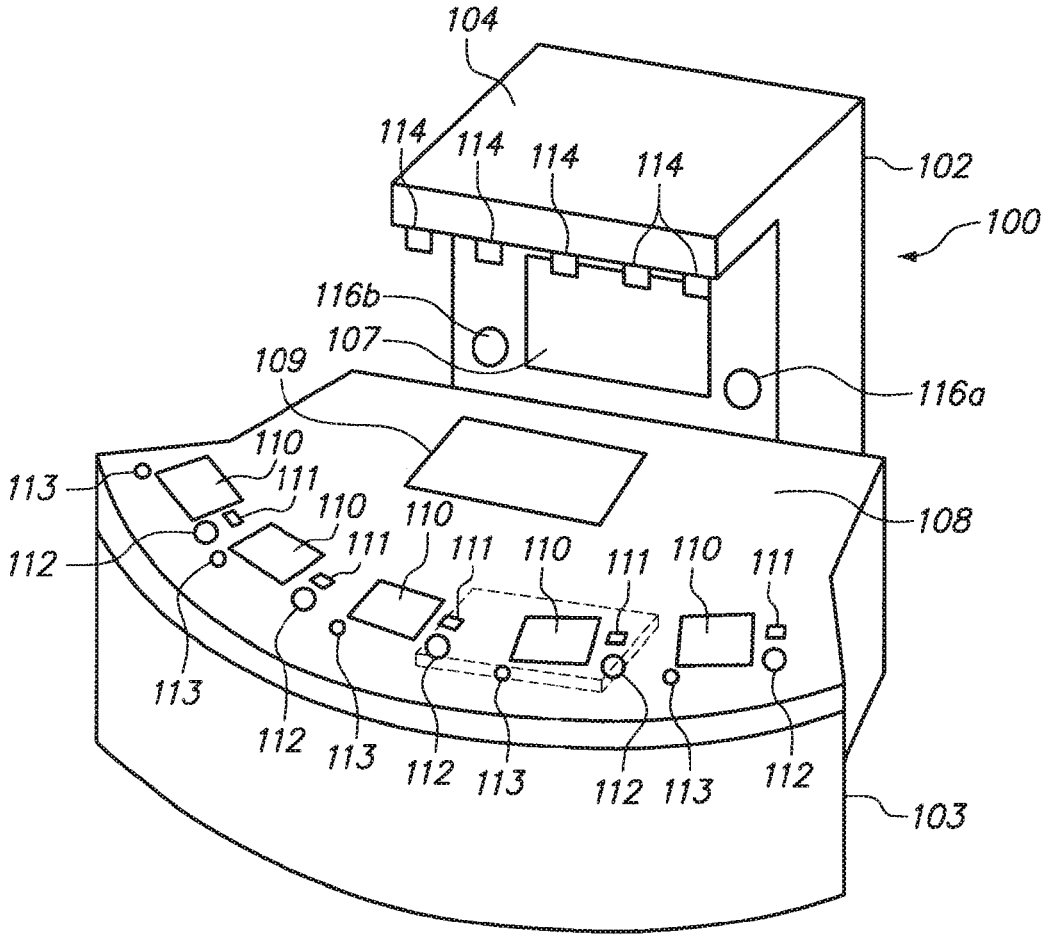
FIG. 3 (PRIOR ART)
FIG. 3 shows a perspective view of a prior art format for an automated gaming system.

FIG. 3 shows a fully automated gaming system 100 of the prior art, as disclosed in U.S. Patent Publication No. 2003/0199316. The gaming system 100 comprises a vertical upright display cabinet 102 with an upper surface 104 and a player bank or station cluster arrangement 103. The vertical display cabinet 102 has a viewing screen 107 on which images of the virtual dealer are displayed. A substantially horizontal top 108 of the player bank arrangement 103 has individual monitor screens 110 for each player position, as well as tabletop inserted coin acceptors 111, and player controls 112 and 113. There is a separate and larger game play screen 109 on which dealer and player cards are displayed in a format large enough for all players to view. Additionally, wager areas and/or virtual chips representing wagers are also displayed in this area. Speakers 116*a* and 116*b* are provided for sound transmission, and decorative lights 114 are provided.

Figure 4:
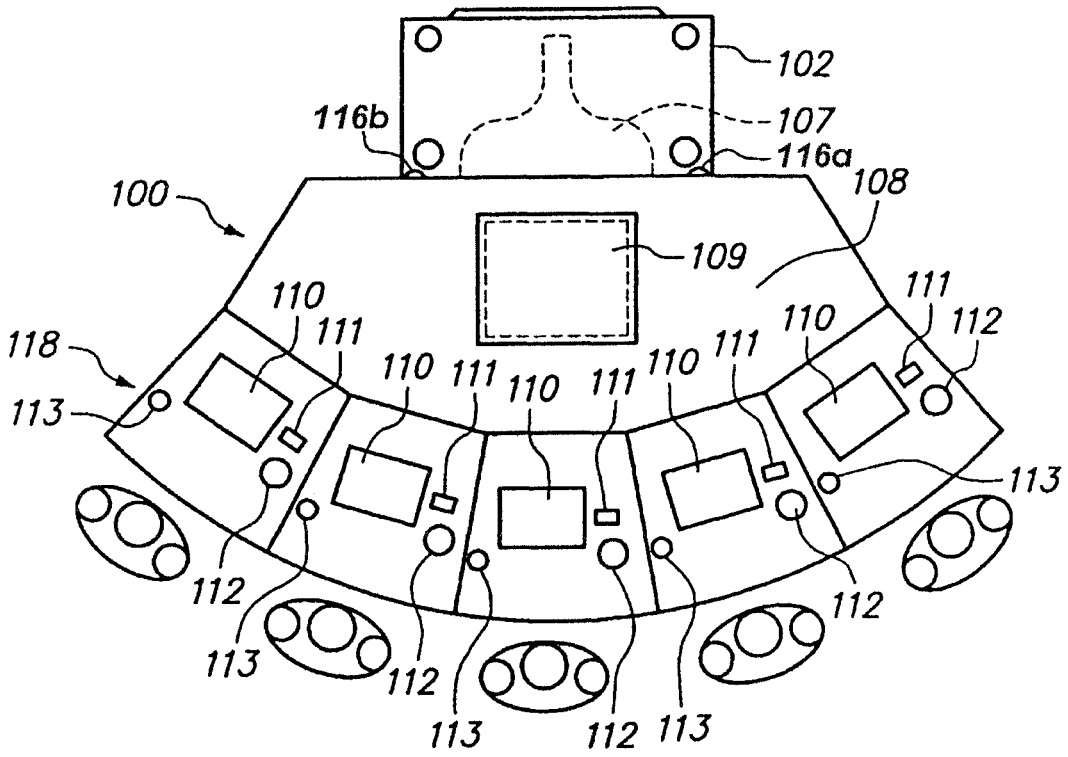
FIG. 4 (PRIOR ART)
FIG. 4 illustrates a top plan view of a prior art format for an automated gaming system.
Figure 5:
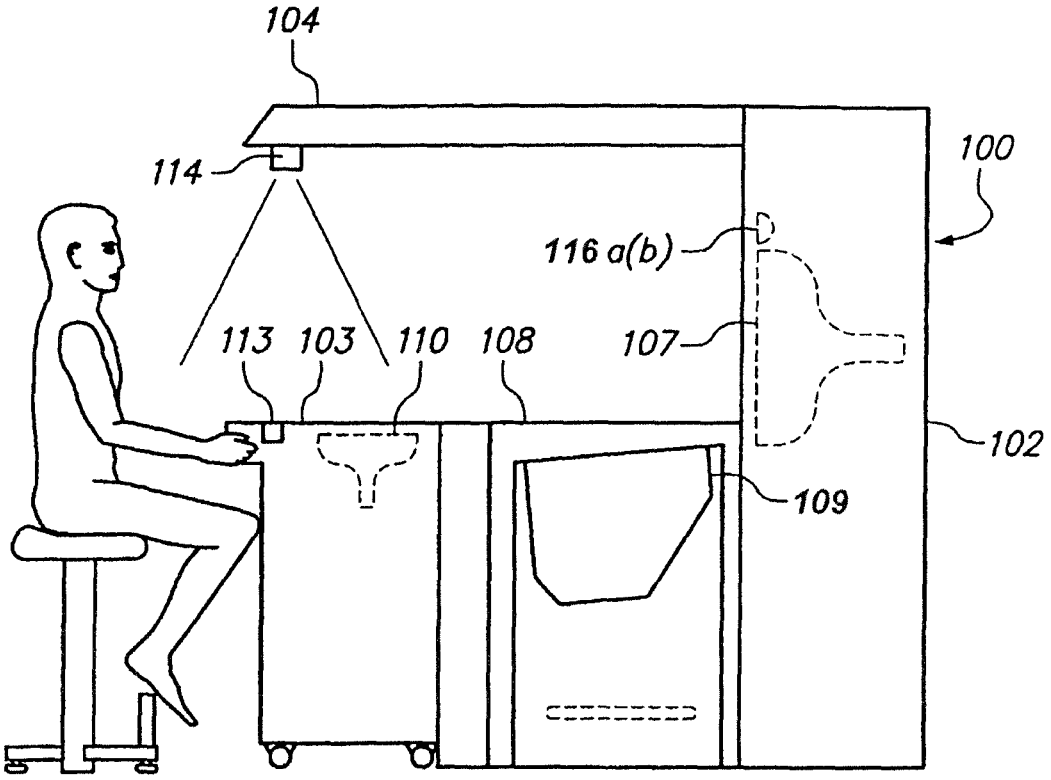
FIG. 5 (PRIOR ART)
FIG. 5 illustrates a side elevational view of a prior art format for an automated gaming system.

FIG. 4 shows a top plan view of the same prior art automated gaming system 100 with the viewing screen 107 shown more clearly as a CRT (cathode ray tube) monitor. It can also be seen that each player position forms an arc arranged in the semicircular player seating area 118. FIG. 5 shows a side elevational view of the same prior art automated gaming system of FIGS. 3 and 4, where the orientation of the three different types of CRT monitor screens 107, 109, 110 are shown.

Figure 6:
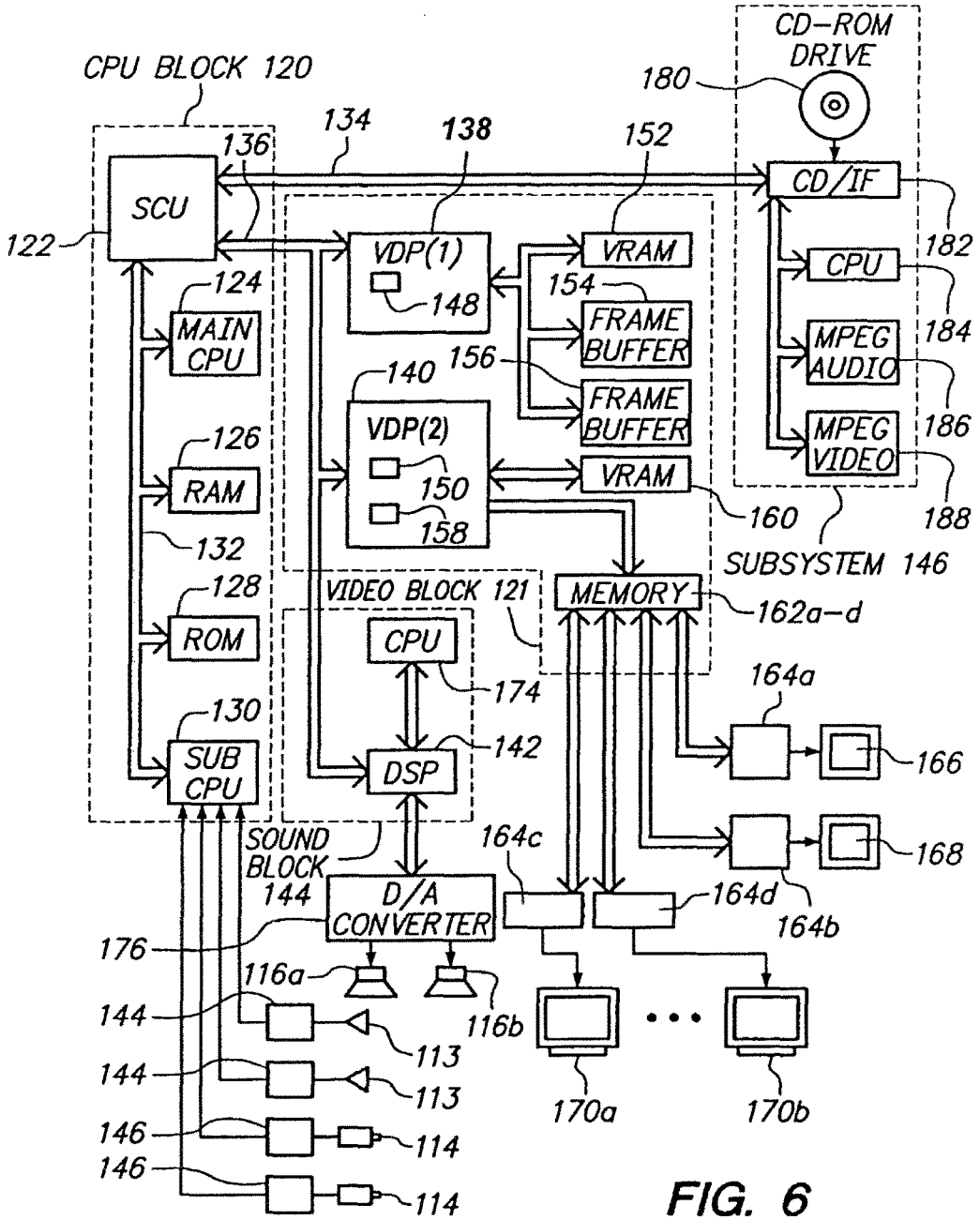
FIG. 6 (PRIOR ART)
FIG. 6 illustrates a block schematic diagram of an electronic configuration of a prior art automated gaming system.

FIG. 6 shows the schematic circuitry of a prior art automated system as disclosed in U.S. Patent Publication No. 2003/0199316. FIG. 6 is a block diagram of processing circuitry in the automated gaming system 100 of FIGS. 3-5. The processing circuitry comprises a CPU (central processing unit) block 120 for controlling the whole system, a video block 121 for controlling the game screen display, a sound block 144 for producing sound effects and the like, and a subsystem 146 for reading out CD-ROM.

The CPU block 120 comprises a SCU (system control unit) 122, a main CPU 124, RAM (random access memory) 126, ROM (read-only memory) 128, a sub-CPU 130, and a CPU bus 132. The main CPU 124 contains a math function similar to a DSP (digital signal processor) so that application software can be executed rapidly.

The RAM 126 is used as the work area for the main CPU 124. The RAM 126 stores the initialization program used for the initialization process. The SCU 122 controls the busses 132, 134, 136 so that data can be exchanged smoothly among the VDPs (video display processors) 138, 140, the DSP 142, and other components.

The SCU 122 contains a DMA (direct memory access) controller, allowing data (polygon data) for character(s) in the game to be transferred to the VRAM 152, 160 in the video block 121. This allows the game machine or other application software to be executed rapidly. The sub-CPU 130 is termed an SMPC (system manager and peripheral control). Its functions include collecting sound recognition signals from the sound recognition circuit 144 (sound block) or image recognition signals from the image recognition circuit 146 (subsystem) in response to requests from the main CPU 124. On the basis of sound recognition signals or image recognition signals provided by the sub-CPU 130, the main CPU 124 controls changes in the expression of the character(s) appearing on the game screen, or performs image control pertaining to game development, for example. The video block 121 comprises a first VPD (video display processor) 138, for rendering TV game polygon data characters and polygon screens overlaid on the background image, and a second VDP 140, for rendering scrolling background screens, performing image synthesis of polygon image data, and scrolling image data based on priority (image priority order), performing clipping, and the like. The first VDP 138 houses a system register 148 and is connected to the VRAM (DRAM) 152 and to two frame buffers 154 and 156. Data for rendering the polygons used to represent TV game characters and the like is sent to the first VDP 138 through the main CPU 124, and the rendering data written to the VRAM 152 is rendered in the form of 16- or 8-bit pixels to the rendering frame buffer 154 (or 156). The data in the rendered frame buffer 154 (or 156) is sent to the second VDP 140 during the display mode. In this way, buffers 154, 156 are used as frame buffers, providing a double buffer design for switching between rendering and display for each individual frame. Regarding information for controlling rendering, the first VDP 138 controls rendering and display in accordance with the instructions established in the system register 148 of the first VDP 138 by the main CPU 124 via the SCU 122.

The second VDP 140 houses a register 150 and color RAM 158 and is connected to the VRAM 160. The second VDP 140 is connected via the bus 136 to the first VDP 138 and the SCU 122 and is connected to picture output terminals Voa through Vog (not depicted) through memories 162*a*-162*d* and encoders 164*a*-164*d*. The picture output terminals Voa through Vog are connected through cables to the main game displays 166, 168 and the satellite displays 170*a*, 170*b*.

Scrolling screen data for the second VDP 140 is defined in the VRAM 160 and the color RAM 158 by the main CPU 124 through the SCU 122. Information for controlling image display is similarly defined in the second VDP 140. Data defined in the VRAM 160 is read out in accordance with the contents established in the register 150 by the second VDP 140 and serves as image data for the scrolling screens that portray the background for the character(s). Image data for each scrolling screen and image data of texture-mapped polygon data sent from the first VDP 138 is assigned display priority (priority) in accordance with the settings in the system register 148, and the final image screen data is synthesized.

Where the display image data is in palette format, the second VDP 140 reads out the color data defined in the color RAM 158, in accordance with the values thereof, and produces the display color data. Color data is produced for each main game display 166, 168 and for each satellite display 170*a*, 170*b*. Where display image data is in RGB format, the display image data is used "as is" as display color data. The display color data is temporarily stored in memories 162*a*-162*d* and is then output to the encoders 164*a*-164*d*. The encoders 164*a*-164*d* produce picture signals by adding synchronizing signals to the image data, which is then sent via the picture output terminals Voa through Vog to the displays 166, 168 and the satellite displays 170*a*, 170*b*. In this way, the images required to conduct an interactive game are displayed on the screens of the displays 166, 168 and the satellite displays 170*a*, 170*b*.

The sound block 144 comprises a DSP 142, for performing sound synthesis using PCM format or FM format, and a CPU 174, for controlling the DSP 142. Sound data generated by the DSP 142 is converted into two-channel sound signals by a D/A converter 176 and is then presented to audio output terminals Ao via an interface (not shown). These audio output terminals Ao are connected to the input terminals of an audio amplification circuit (not shown). Thus, the sound signals presented to the audio output terminals Ao are input to the audio amplification circuit (not shown). Sound signals amplified by the audio amplification circuit drive the speakers 116*a* and 116*b*.

The subsystem 146 comprises a CD-ROM drive 180, a CD-I/F 182, a CPU 184, an MPEG-AUDIO section 186, and an MPEG-PICTURE (i.e., MPEG-VIDEO) section 188. The subsystem 146 has the function of reading application software provided in the form of a CD-ROM and reproducing the animation. The CD-ROM drive 180 reads out data from the CD-ROM. The CPU 184 controls the CD-ROM drive 180 and performs error correction on the data read out by it. Data read from the CD-ROM is sent via the CD-I/F 182, bus 134, and SCU 122 to the main CPU 124, which uses it as the application software. The MPEG-AUDIO section 186 and the MPEG-VIDEO section 188 are used to expand data that has been compressed in MPEG (Motion Picture Expert Group) format. By using the MPEG-AUDIO section 186 and the MPEG-VIDEO section 188 to expand data that has been compressed in MPEG format, it is possible to reproduce a motion picture. It should be noted herein that there are distinct processors for the CPU block, video block, sound block, CD-ROM drive, and memory with their independent CPUs. This requires significant computing power and still has "dumb" (no intelligence) player input components.

Figure 7:
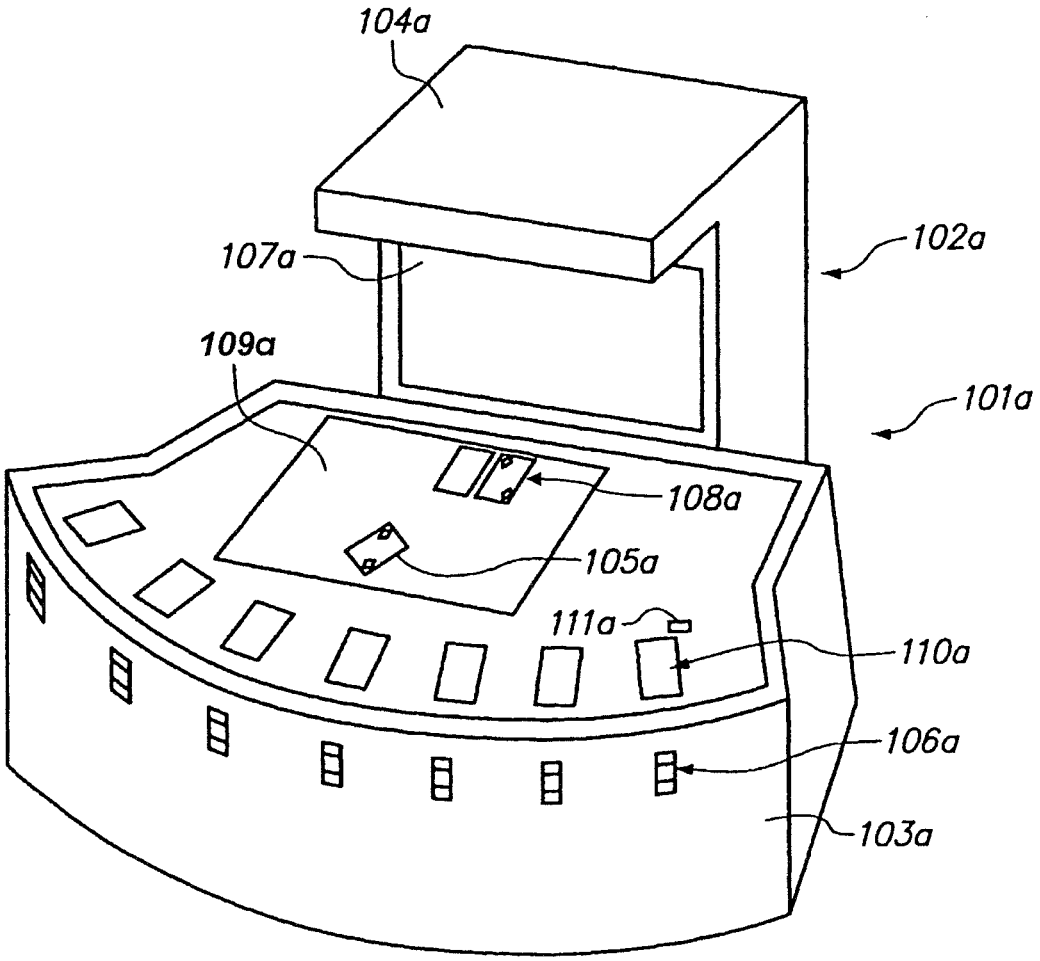
FIG. 7 illustrates a perspective view of a format for an automated gaming system according to the present invention.

FIG. 7 shows another example of an automated table system 101*a* useful to practice the game play methods of the present invention. The system 101*a* has an upright dealer display cabinet 102*a* with a top 104*a* and a dealer viewing screen 107*a*, which may be any form of display screen such as a CRT, plasma screen, liquid crystal screen, LED screen, or the like. The dealer screen 107*a* displays a virtual dealer (not shown), the dealer responding to instructions from the players. The player bank arrangement 103*a* has a continuous display screen 109*a* on which images of cards being dealt (e.g., cards 105*a*), dealer's cards 108*a*, player cards (e.g., cards 105*a*), bets wagered (not shown), and also includes touchscreen and/or electromechanical player input functions in a display 110*a*. The display 110*a* at each player station can also display information such as the composition of the player's hand, the credits wagered, historical win/loss information, pay tables, and the like. Other player input functions may be provided on a panel 106*a*, which might accept currency, coins, tokens, identification cards, player tracking cards, ticket in/ticket out acceptance, and the like.

Figure 8:
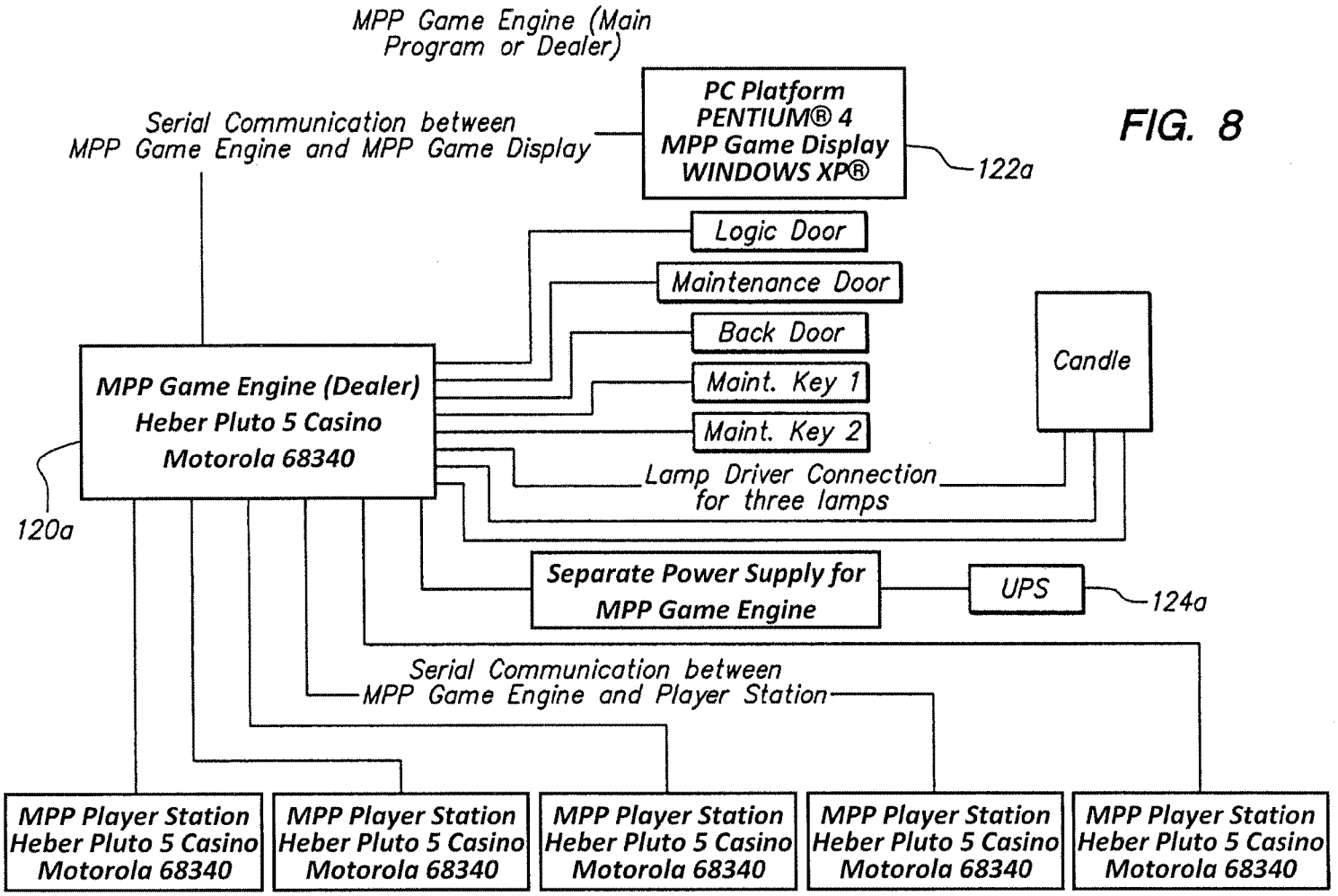
FIG. 8 illustrates a schematic diagram of a gaming engine useful in the practice of the present invention.

FIG. 8 shows an electronic/processor schematic for a multiplayer platform (MPP) gaming system according to the presently described invention. The MPP Game engine (dealer) comprises a Heber Pluto 5 casino game board 120*a* (Motorola 68340 board) operating off the PC Platform PENTIUM® 4 MPP game display processor 122*a*. The game display processor operates on a WINDOWS XP® platform. The respective subcomponents on the PENTIUM® 4 processor are labeled to show the apportionment of activity on the motherboard and the component parts added to the board. As is shown, the game engine has an uninterruptible power supply 124*a*. The game display processor 122*a* directs activity on the speakers and directs activities onto the MPP game service panel and the plasma monitor card table display. It is important to note that all communications are direct from the game display processor, freeing up resources available to the game engine processor.

Figure 9:
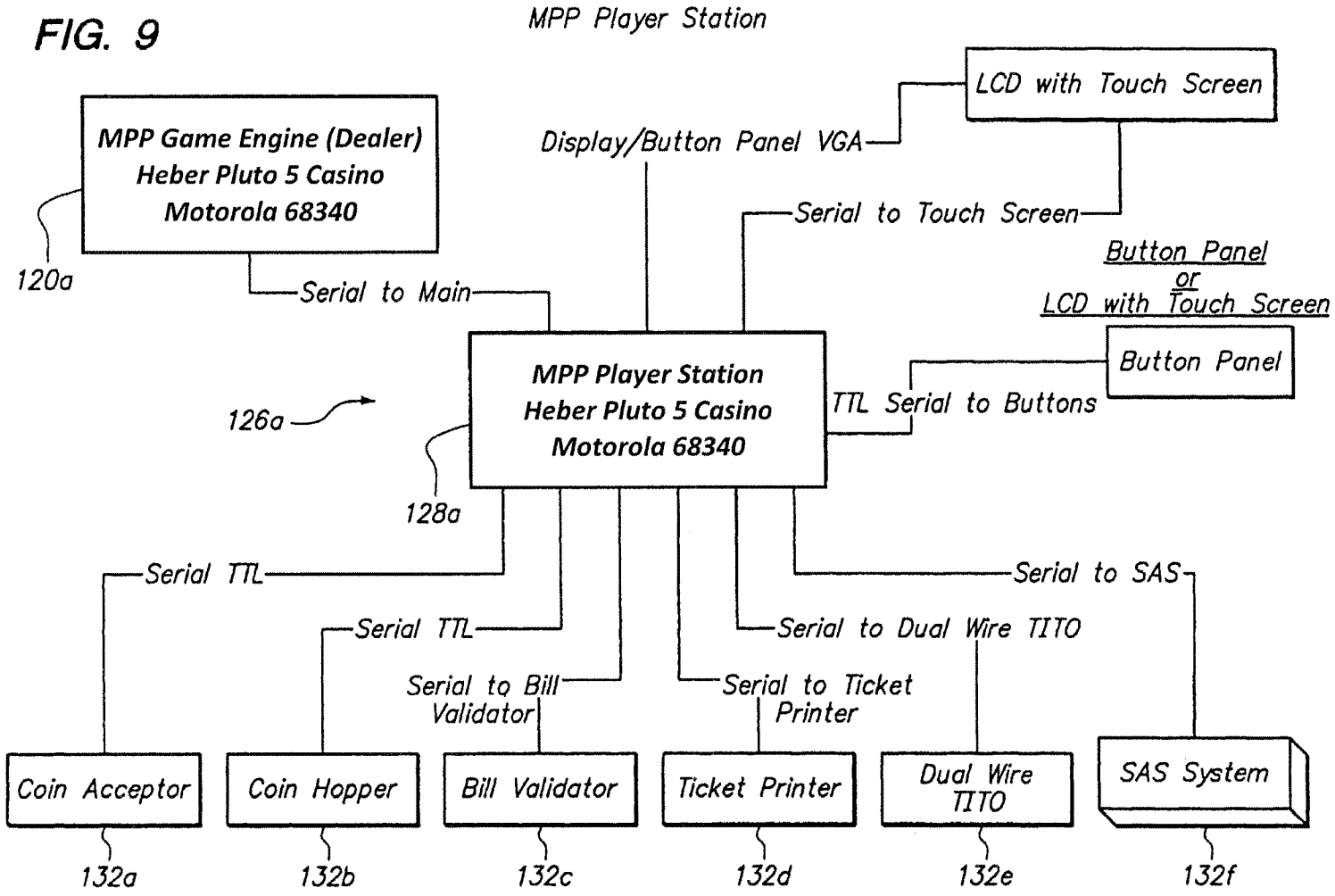
FIG. 9 illustrates a schematic diagram of a player station useful in the practice of the present invention.

FIG. 9 shows the electronic/processing schematics 126*a* of the MPP player station intelligence board 128*a* (Heber Pluto 5 Casino, Motorola 68340), each of which player stations (one for each player position) is in direct connection to the MPP game engine 120*a* (dealer), which is in turn directly connected to the PC platform (not shown in this figure). Each intelligence board receives information for all player input systems 132*a*-132*f* specific to that player station, such as the shown coin acceptor 132*a*, coin hopper 132*b*, bill validator 132*c*, ticket printer 132*d*, touchscreen and/or display button panel, dual wire ticket-in/ticket-out printing 132*e*, and SAS system 132*f* (SAS is one exemplary standard communications protocol used by a number of casinos' central computer systems). A significant benefit resides in the use of the independent intelligence boards 128*a* at each player position being in direct communication with the MPP game engine 120*a*, as opposed to each individual player position button panel being "dead" or "inactive" until authorized by the main game processor, as previous automated gaming systems were constructed.

The above-described architecture is also an improvement in providing a system with not only the intelligence at each player position, but also in redistributing processing capability for functions among various processing components within the gaming system. In one architectural format, all functions of the gaming engine, except for the player localized intelligence functions, are consolidated into a single PC (e.g., the PENTIUM® 4 shown in the figures). This would include all game functions, player video functions, dealer video functions, dealer audio functions, security, central reporting (to a casino's central computer, for example), currency and debit functions, alarm functions, lighting functions, and all other peripherals on the system, except for the localized player functions. Alternatively, all functions requiring communication with the casino's main computer system are located on the player station intelligent boards. In this system, the main game processor would communicate directly with the player intelligent boards, preferably in the same novel communication format described below.

Figure 10:
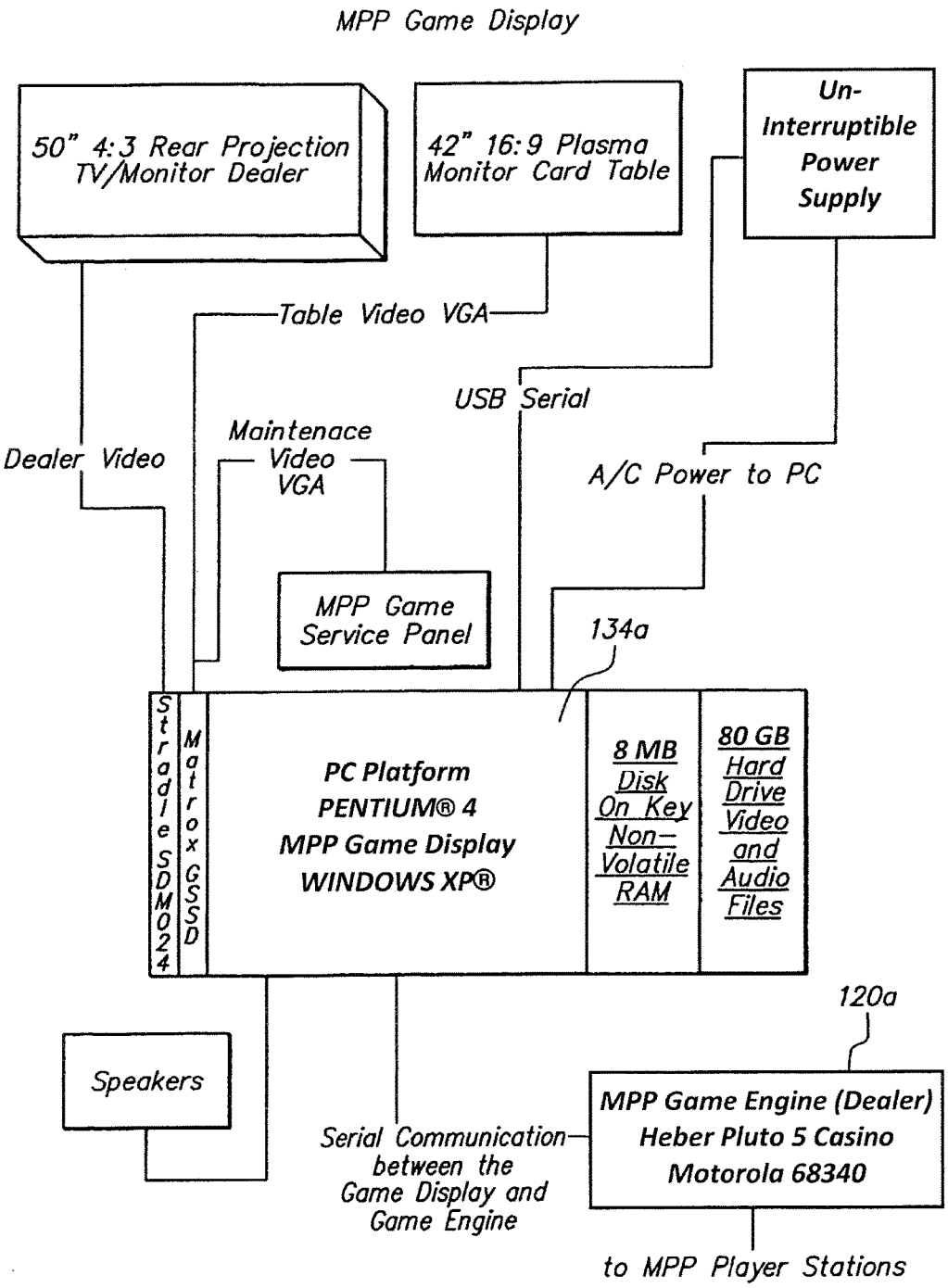
FIG. 10 illustrates a schematic diagram of a game display useful in the practice of the present invention.

An alternative system is shown in FIG. 10, wherein a dealer engine processor 120*a* is intermediate to a main game PC 134*a* and the player intelligent boards (not shown). Both systems are a distinct improvement over the prior art, but with the higher power available for PCs and with the ease of programming a PC as opposed to an embedded system, the consolidation of the game functions and the ability of the main game engine to communicate with each of the player positions is enabled. As shown in FIG. 10, the game display processor 134*a* is preferably a PENTIUM® 4 PC and is separate from the main processor 120*a*. With the player intelligent boards, the main game PC can receive packets of information from each player station as events occur, rather than having to poll each player position on a regular basis 100 times to gain the specific information for each player input that may be made.

A description of the Heber Board (an exemplary board that can be used as a player station processor and/or game engine processor 120*a*), a commercially available intelligent processing board, is as follows. The Heber Board is known for its reliability and flexibility, especially for the Pluto 5 family of gaming products. The Pluto 5 is the controller of choice for the global gaming industry. Flexibility comes from a set of features built into the Pluto 5 (casino) controller, and from the choice of optional add-on boards that can be used to adapt the Pluto family to best suit individual applications. In the area of interfacing, there are three distinct boards, each of which serves a particular function in helping the Pluto 5 to connect with the world outside:

RS485 Board

An RS485 is an industrial-grade board for linking multiple systems in unforgiving circumstances for centralized information gathering. The Heber RS485 board is fully optically isolated to provide complete circuit safety when used within "electrically noisy" environments. The RS485 board uses a single RS232 connection to the Pluto 5 board, and all necessary power is also derived through this link. Two header connectors may be provided for the RS485 channel to allow daisy chain connections between multiple systems.

HII/ccTalk Board

This board specializes in communicating with industry standard note/coin acceptors and payout hoppers. Equipped with dual communication channels, each port is configurable to use either the HII format to connect with MARS® coin/note acceptors or the ccTalk format for MONEY CONTROLS™ hoppers. Both channels are controlled via a single RS232 connection to the Pluto 5 board, and all necessary power is also derived through this link. The Heber FASTTRACK™ package contains modular library functions for passing information via these channels.

Four-Channel Relay Board

The relay board allows control of medium- to high-level loads, such as solenoids, without risk of damage or interference to the Pluto 5 circuitry. Four power-switching channels are available with absolute isolation from the Pluto 5 control signals. Each relay is capable of switching direct or alternating currents of up to 7 A at a maximum voltage of 250 V.

Like the Pluto 5 board itself, its modular options have been used extensively so that their designs are fully developed and entirely stable. The options that are specified are consistently provided in mass quantities. As with all Pluto products, programming for the modular options is straightforward. This is enhanced with the use of the Pluto 5 Enhanced Development Kit and also the FASTTRACK™ package. Between them, these kits contain all of the low-level and high-level programming tools and library functions needed for gaming applications. These systems can be provided through a Pluto 5 Enhanced Development Kit datasheet 80-15353-7 (Heber Limited, Belvedere Mill, Chalford, Stroud, Gloucestershire, GL6 8NT, UK Tel: +44 (0) 1453 886000 Fax: +44 (0) 1453 885013, on the worldwide web at heber.co.uk. Specifications for the various boards are identified below:

RS485 Interface
Host Interface
RS232 connection to Pluto 5/Pluto 5 Casino
All power provided via RS232 link from host system
Communication Port
Dual four-way Molex 0.1" KK headers for daisy chaining purposes
Dimensions
80 mm×61 mm (3.14 inches×2.4 inches)
Part Number
Opto-isolated RS485 board 01-14536-2
HII/ccTalk Interface
Host Interface
RS232 connection to Pluto 5/Pluto 5 Casino
All power provided via RS232 link from host system
Communication Port
Single or dual ten-way header connectors
Dimensions
101.6 mm×69.85 mm (4 inches×2.8 inches)
Part Number
Dual channel HII/ccTalk board 01-16171-2
Four-Channel Relay Board
Host Interface
Connection to Pluto 5/Pluto 5 Casino via ribbon cable using four standard output lines
All power provided via ribbon cable link from host system
Switching Capabilities
Up to 250 V AC or DC at 7 A maximum per channel
Dimensions
80 mm×61 mm (3.14 inches×2.4 inches)
Part Number
Four-channel relay board
01-15275-1
80-16949-1

One proposed hardware configuration uses a "satellite" intelligent processor at each player position. The player station satellite processor is substantially the same as the primary game engine processor, a Heber Pluto 5 Casino board. The satellite processors receive instruction from the primary game engine but then handle the communications with player station peripherals independently. Each satellite processor communicates with only the peripherals at the same player station. Thus, each player station has a dedicated satellite processor communicating with only the peripherals at the same player station and with the casino's central computer system. The peripherals are, but are not limited to, slot account systems, a bill validator, a ticket printer, a coin acceptor, a coin hopper, meters, a button panel, or a LCD touchscreen, and various doors and keys.

The satellite processors run proprietary software to enable functionality. The player station software comprises two modules, the first being an OS similar to the game engine operating and the second being station software that handles peripheral communications. The software may be installed on EPROMs for each satellite processor. The primary method of communication between the satellite processors and the primary game engine is via serial connectivity and the previously described protocol. In one example, information packets are prepared by the satellite processors and are sent to the game engine processor on the happening of an event.

The proposed game engine provides communication to the player stations to set the game state, activate buttons, and receive button and meter information for each player station. Communication is via a serial connection to each of the stations. The new protocol for communication between the game engine, game display, and player stations is an event driven packet-for-packet bi-directional protocol with cyclic redundancy check (CRC) verification. This is distinguished from the Sega system that used continuous polling. This communication method frees up resources in the same engine processor because the processor no longer needs to poll the satellites continuously or periodically.

The new protocol uses embedded acknowledgement and sequence checking. The packet-for-packet protocol uses a command packet, response packet, and a synchronization packet as illustrated below. The protocol uses standard ASCII characters to send data and a proprietary verification method.

Format of Command Packet

| STX | SEQ | DATA LENGTH | DATA | CRC-16 | ETX |
|---|---|---|---|---|---|
| 1 | 1 | 3 | 3-999 | 5 | 1 |

Format of Response Packet

| STX | SEQ | DSP | PRV | ETX |
|---|---|---|---|---|
| 1 | 1 | 1 | 1 | 1 |

Format of Synchronization Response Packet

| STX | MTS | MRS | ETX |
|---|---|---|---|
| 1 | 1 | 1 | 1 |

Legend for the figures:

| | |
|---|---|
| STX | Start of Packet Character |
| SEQ | Sequence # (Cycles from "0" thru "9") |
| LEN | Length of Data Area ("003" thru "999") |
| DATA | ASCII Data Fields Separated with "\|" Character |
| CRC | CRC-16 Value ("0000" thru "65535") Cyclic Redundancy Check |
| ETX | End of Packet Character |
| DSP | Disposition Code ("A" ACK, "N" NAK, or "I" Invalid Sequence) |
| PRV | Sequence Number of Last ACK'ed Packet ("0" through "99") |
| MTS | Main's Current Transmit Sequence Number |
| MRS | Main's Current Receive Sequence Number |

The command packet and response packet are used during primary game communications. The protocol uses redundant acknowledgement. For example, the packet is initially acknowledged when first received by the recipient. The same recipient will resend another acknowledgement in the next communication. This second acknowledgement is the "PRV" data in the response packet.

The communications between the game engine and the player station intelligence is preferably a transaction-based protocol. Either device can start a transaction, which is why it is essential that there be an intelligent board at each player position. All packets of information may be sent in any acceptable format, with ASCII format preferred as a matter of designer choice. All command packets usually contain a sequence number that is incremented after each successful packet exchange. The game engine and the player station intelligence use sequence numbers that are independent of each other. The sequence number keeps the communications in synchronization. This synchronization method is described below.

The command packet is used to send various commands such as inputs, lamps, doors, errors, chirps, game results, player inputs, coin acceptances, player identifications, credit acceptances, wagers, etc. The command packet format may be, by way of a non-limiting example:

<STX><Sequence number><Data Length><Data><CRC-16><ETX>

The data format within the command packet may be:

<Address><Command><Field 1>|<Field 2>|<Field n>|

The response packet format may be:

<STX><Sequence number><Disposition><Previous ACK><ETX>

The sync request packet format may be:

<SYN>

The sync response packet format may be:

<STX><Mains Current Transmission Sequence><Mains Current Receive Sequence><ETX>

A major strength of the protocol is its resilience of the game protocol and its ability to free up resources within the game engine. Those resources can, in turn, be used to provide more intricate games and multi-media affects.

Synchronization Method

The satellite and host must become synchronized in order to provide for reliable communications using packet numbers. To facilitate this, a novel protocol synchronization method is used. Upon applying power to the satellite, or after a communications failure, the satellite automatically enters into synchronization mode. In the synchronization mode the satellite sends out the ASCII SYN (0x16) character about every second. It is expected that a special response packet containing transmit and receive packet sequence numbers will be used from that point on. After receiving the special response packet, the sequence numbers are used "as is" and are not incremented until a successful packet exchange is completed. After communications are synchronized, the sequence numbers are incremented after each packet is successfully sent or received.

As was noted before, the main game processor may contain information, data, programming, and other necessary functions to enable the play of multiple games off the same machine. For example, the main game engine may have rules and commands that will enable play of high and low games of the present invention and other card games. The system may be controlled so that different games may be played at different times on command of the casino or players.

Chipless Table Gaming Systems

Game profitability is influenced strongly by the speed at which a game is played. Gaming platforms that increase game speed, eliminate payout errors, facilitate cash-outs, prevent player/dealer collusion, and generally prevent cheating are highly desirable for casinos.

Chipless table gaming systems (CTGS) game platforms operate on credit instead of using traditional gaming chips. However, a player may cash in or out with gaming chips, as a convenience to casino patrons. In systems that track wager amounts, chipless gaming tables eliminate the cost of purchasing special chips. Wager amounts are electronically recorded, eliminating the need for more costly RFID chips and antenna technology to monitor game play.

Figure 11:
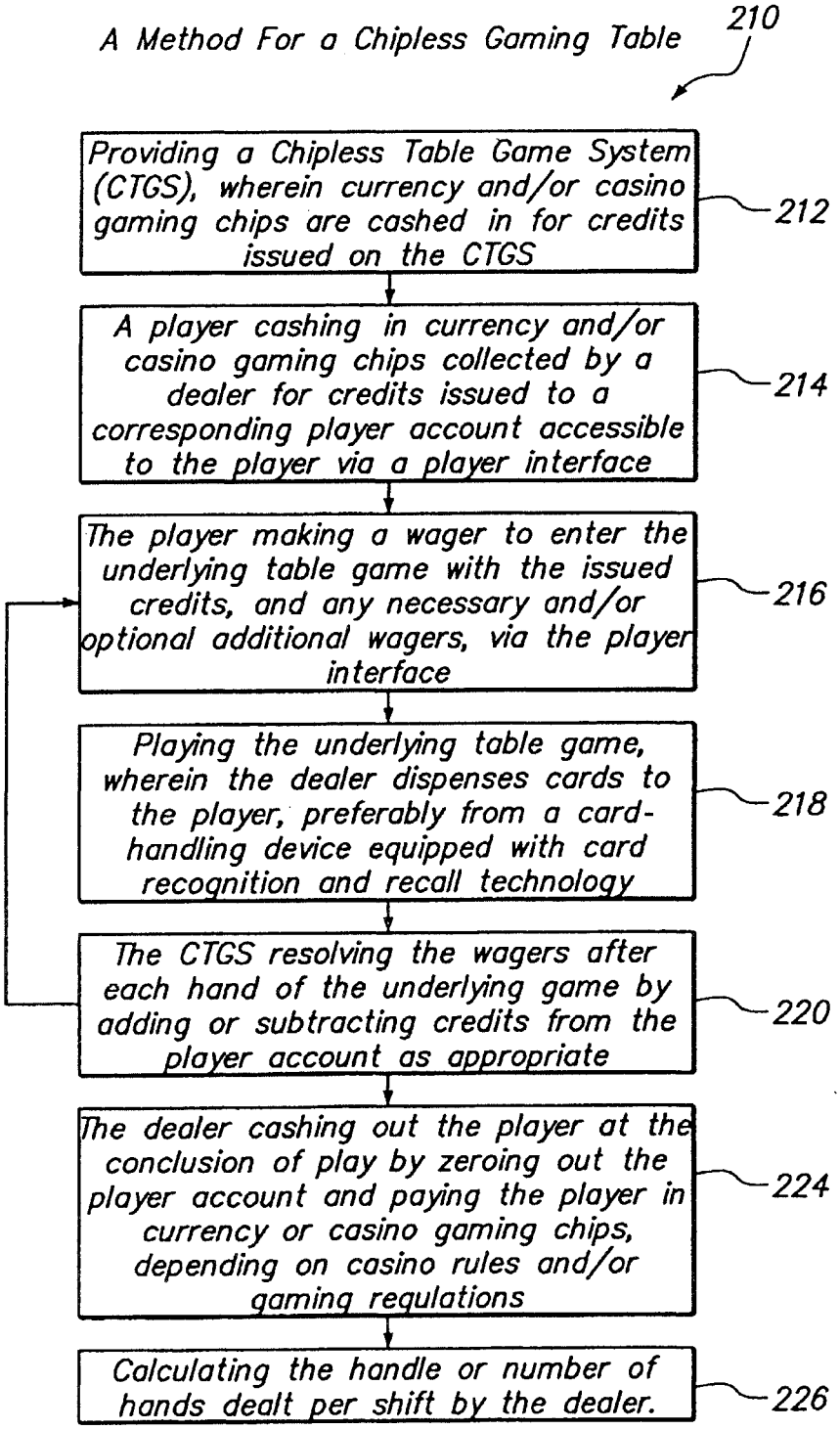
FIG. 11 illustrates a flow diagram of an exemplary process of the present invention.

FIG. 11 is a flow diagram for a method 210 of administering a card game on an exemplary chipless table game system (CTGS). A CTGS is provided at step 212. The CTGS generally has a dealer station with an electronic dealer interface and a plurality of player stations, each including an electronic player interface, such as a display with touch-screen controls, and operates with purchased credits instead of casino gaming chips. At step 214, a dealer "cashes-in" a player wishing to join the underlying table game by accepting currency or casino gaming chips and issuing credits for a player to wager with to the corresponding player account accessible to the player via the player interface.

At step 216, the player makes a wager to enter the underlying table game using the credits and also makes any other necessary or optional additional wagers to continue play via the player interface. Then at step 218, the underlying table game proceeds as usual. The dealer dispenses physical cards to the player, preferably from a card-handling device, such as a shoe or a shuffler that is capable of forming random hands of cards. Either type of card-handling device may be equipped with card recognition. Devices that form hands may also be equipped with hand composition and historical hand recall technology. Hand recall information is useful when the game requires a fixed number of cards dealt to each player, and the final hand is determined at the point that the hand is dealt.

Upon conclusion of a hand of play in the underlying game, step 220, the CTGS automatically resolves the wagers by adding or subtracting credits to the corresponding player accounts as appropriate. If requested by the player, the dealer then cashes-out the player at step 224, by zeroing out or resetting the player account and paying the player for any winnings or balance on the account in currency or casino gaming chips, depending on casino rules and/or gaming regulations. If the player chooses to continue play, rather than cashing out, the player makes another wager 216.

At step 226, the CTGS calculates the handle or number of hands dealt per shift by the dealer. This information may be downloaded from the CTGS manually or networked with the house computer system to do this automatically.

As defined herein, a CTGS is a traditional live table game experience on a novel gaming platform that includes a casino game played according to predetermined set(s) of rules, at least one dealer, physical playing cards, and at least one player to place at least one electronic wager to participate in the game provided. The CTGS includes a plurality of electronic player displays, and touchscreen wagering interfaces, the displays preferably flush mounted into the gaming table surface, wherein players place wagers and execute game decisions electronically on displays equipped with touchscreen controls (e.g., liquid crystal diode screens, LCD screens) and/or other touchscreen forms of suitable user interface technology while playing a live table game.

In a preferred embodiment, the CTGS includes a dealer PC/game server, wherein the PC/game server is typically located under the table, but can be located elsewhere in the pit or in a location remote from the pit. Dealer controls are located where they are easily accessed by the dealer, for example, through a dealer I/O system, which may be in front of the dealer, to the side of the dealer (on or associated with the table) and/or in one example, located in the chip tray on the table.

Preferably, the PC/game server is operatively associated with an intelligent card-handling and/or card-reading device located on the table. The device preferably has card-reading capabilities. The intelligent card-handling device (i.e., a card-reading shoe or shuffler) correlates read card rank and suit information with known stored card values to determine rank and suit information and transmits the correlated card data to the dealer PC/game server for use in administering the game. Although card-handling devices that read special card markings on cards can be used as a part of the disclosed systems, it is preferred that the intelligent card-reading devices read the standard rank and/or suit markings on conventional playing cards, eliminating the need for the casino to use specially marked cards.

The dealer PC/game server has a main game controller programmed with the rules of the game (and optionally other games) being executed at a table, wherein the dealer PC/game server receives and correlates the card information received from the card-handling device with known game outcomes, and the dealer PC/game server determines a game outcome(s) based on the actual dealt card values. The dealer PC/game server is in communication with a plurality of electronic player interfaces, wherein each electronic player interface transmits, and receives, up-dated game and wagering information as each game progresses and as each game is eventually concluded.

Figure 12:
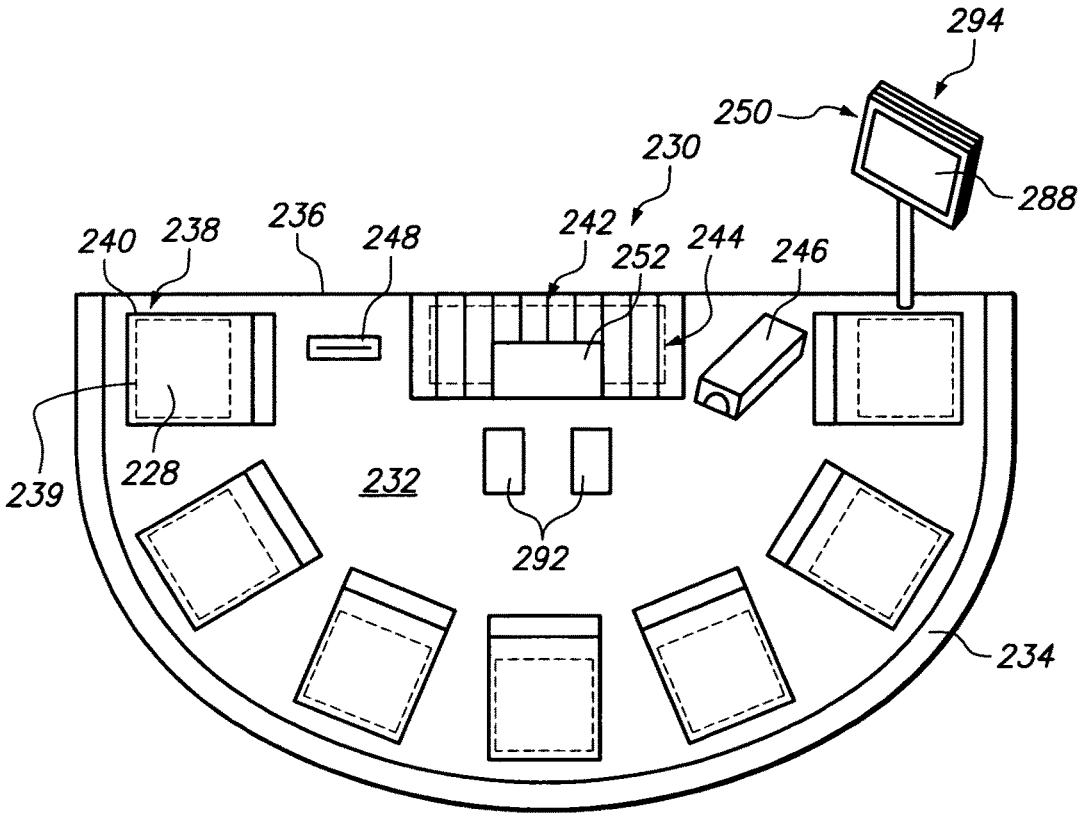
FIG. 12 illustrates a top plan view of an embodiment of a table system layout for the chipless gaming table system described herein.

An exemplary CTGS is shown in FIG. 12. One preferred embodiment of a player display for the chipless table features LCD touchscreen technology, but plasma and/or other suitable technology may be employed as desired. Preferably, a plurality of player displays 228, each equipped with touchscreen controls, are flush mounted into a gaming table surface at each player position. For purposes of illustration, only one player area will be described. It is to be understood that all player areas of the gaming table 230 are equipped with the same equipment. The controls in one embodiment are divided into two separate areas, and the different areas serve a number of purposes, including functioning as a player wagering interface, as will be described in more detail below. It is preferred that each display has its own processor, wherein each processor controls its own display, and each display processor is in communication with a main game controller/game server. In a preferred form of the invention, the display processor administers graphics functions of the display. All other game events are administered by the central game controller.

Gaming table 230 can be of a variety of common constructions or configurations as are typically used as the structural components of gaming tables in the industry. The typical gaming table has a tabletop or playing surface 232 and a perimeter pad or armrest 234 that extends at least about the portion of the table periphery facing players. The relatively straight, back portion of the periphery 236 is used by the dealer (not shown) and can be partly or wholly padded as may vary with the particular table chosen. Seven player display/input systems 238 are shown. Each of the player input systems 238 has a processor 239 (shown in phantom) and a touchscreen entry surface 240. There may be an optional dealer chip tray or rack 242. There is also a game controller, CPU, or casino computer 244 (shown in phantom) whose location is relatively unimportant but must be in direct (hardwired or wireless or networked) communication with each individual player processor, and a card-reading and/or card delivery system 246 from which playing cards are supplied, with at least the rank/count (and preferably also the suit) of individual cards, known as "the cards," removed (for example, one at a time), and delivered to player positions and/or the dealer position. The card delivery system 246 is in communication with controller 244 by wired or wireless communication methods. Although FIG. 12 shows a shoe as an exemplary card delivery system 246, a shuffler is an alternate exemplary card delivery system 246. Additional details of suitable shufflers are described in more detail below. The individual processors 239 could also be in communication link with the game controller 244 by wireless or hardwired connections. Communication is not limited to electronic or electrical signals, but may include optical signals, audio signals, magnetic transmission, or the like.

The playing surface 232 is provided on the table where participants of the card game(s) play. Preferably, this surface is horizontal. One or a plurality of players (not shown) sit or stand along the semicircular portion and play a desired card game, such as the popular casino card games of blackjack, baccarat, poker, and poker variants.

The gaming table 230 advantageously includes a betting chip rack 242, which allows the dealer to conveniently store betting chips used by the dealer in cashing players in and out of the game. A money drop slot 248 is further included to allow the dealer to easily deposit paper money bills therein when players purchase credits.

Table 230 can support a system, or form a part of a system, for playing live card games, which table 230 is constructed according to the present disclosure. The card game table 230 described herein, in one example of the invention, is a retrofit system that has been added to a standard gaming table support frame. Such a retrofit system includes an upright, pole-mounted communal player display 250 that displays images that depict game information such as pay tables, hand counts, win/loss information, historical win/loss information by player, and a wide variety of other information considered useful to the players. The display 250 is a two-sided display that will be explained more fully below.

The system also preferably includes a dealer control 252 that is preferably provided in the form of a display with touchscreen controls positioned within the chip rack 242. In an alternative embodiment, the dealer control 252 resides on the card-dispensing device 246 or as a separate keypad (not shown). The individual player position processors 239 are preferably graphics processors and not full content CPUs, as a cost saving, space saving, and efficiency benefit. With the reduced capacity in the processor, as compared to a more robust CPU 244, there is actually reduced likelihood of tampering and fraudulent input.

Figure 13:
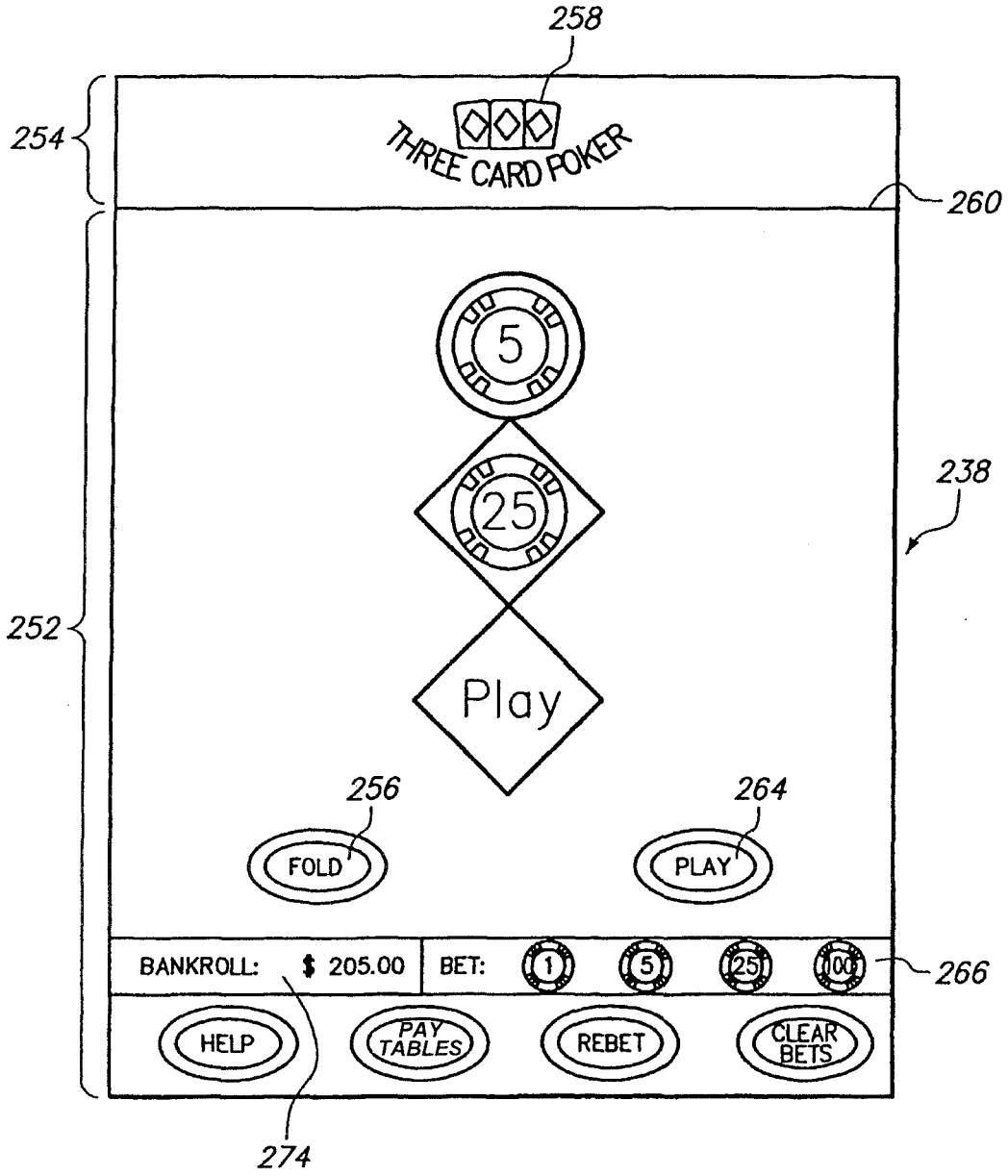
FIG. 13 illustrates an exemplary player display, with game identification information displayed in the dealer area of the display.

One preferred embodiment of the player input system 238, as shown in FIG. 13, enables the player to input play decisions as well as wagering decisions. For example, the player portion 252 of the display includes game information and allows the player to input commands that are carried out by the dealer. For example, the player could input a "fold" command by depressing keypad control 256, causing the dealer to remove the player cards from the table. Although the specific game being displayed is unimportant to the structure of CTGS, the information being displayed and the player decision inputs are dependent upon the game. For example, in the game of blackjack, "stand" and "hit" instructions can be communicated via touchscreen controls to a game controller and can provide a visual instruction to the dealer (not shown).

Figure 14:
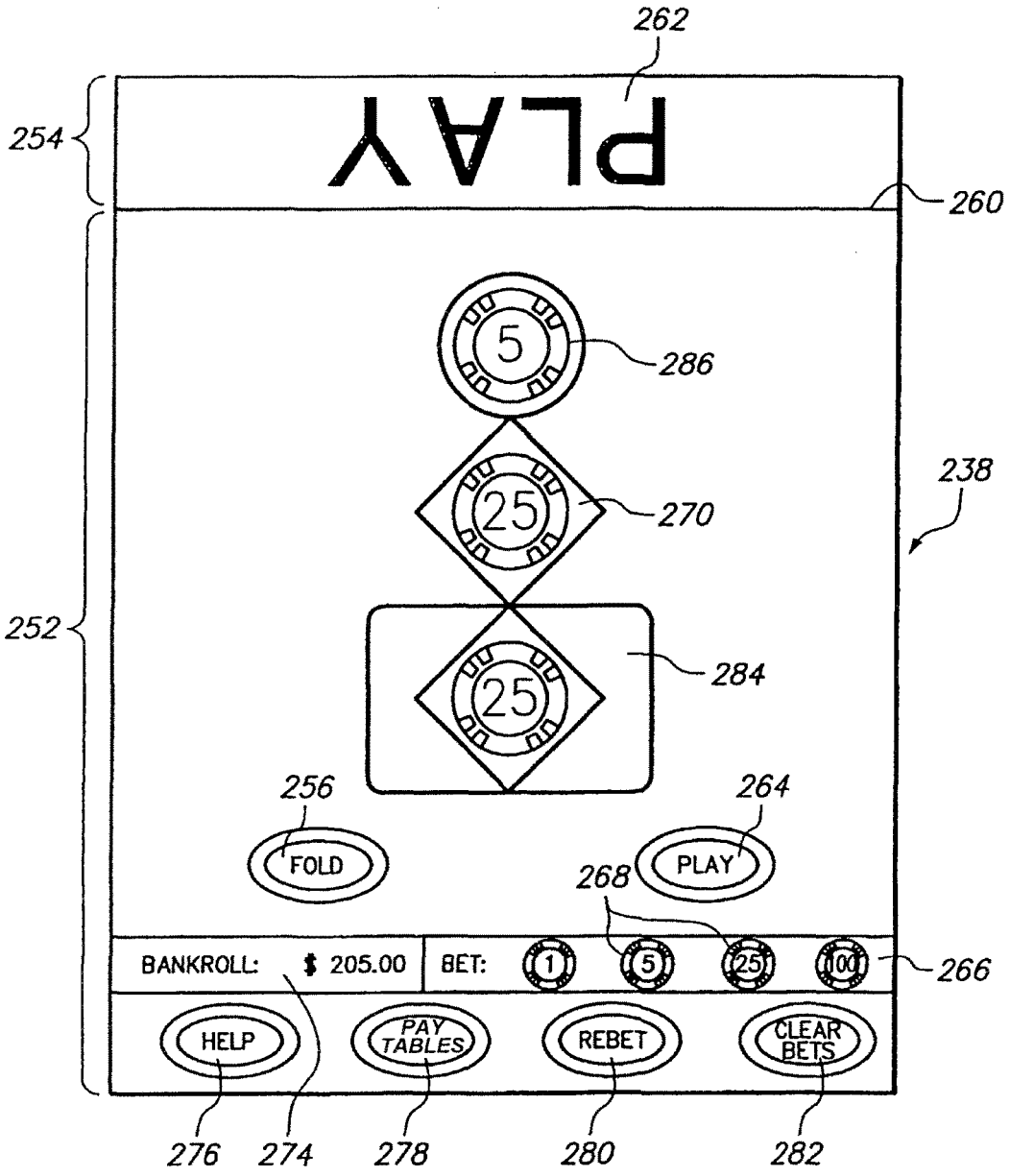
FIG. 14 illustrates an exemplary player display, with dealer instructions displayed in the dealer area of the display.

The player display 238 is advantageously divided into a first player area 252 and a second dealer area 254. The second dealer area 254 has multiple inventive functions as will be described in more detail below. In a first mode, the dealer area 254 displays game identity information 258 to the player. The game identity information 258 may include a game name, a distinctive graphic, or combinations thereof, or any information useful in attracting a player to participate in the game. In a second mode, as shown in FIG. 14, the dealer area 254 provides instructions 262 to the dealer to assist in administering the game. For example, a "play" instruction 262 is shown in dealer area 254. This "play" instruction is displayed in response to the player depressing the "play" button 264 on the player controls. Once this "play" instruction is entered, the word "PLAY" 262 appears in the dealer area 254 in an orientation convenient for viewing by the dealer. In the game being displayed, the "play" wager is equal to the "ante" wager (area 284), so, by depressing the "play" button 264, the system is prompted to transfer virtual chips 268 from a virtual chip tray 266 onto "play" wager area 270 in an amount equal to the ante wager. When the rules of the game require the player to decide the amount of the wager, the player must touch a virtual chip or chips 268 in the virtual chip tray 266 and drag the virtual chip or chips 268 to the betting area to complete the wagering step.

In other games that require the dealer to deal additional cards, reveal cards, sweep bets, and perform other administrative functions, the specific instructions may be displayed in dealer area 254. This information is then used by the dealer to take action or refrain from resolving hands or sweeping wagers.

Figure 15:
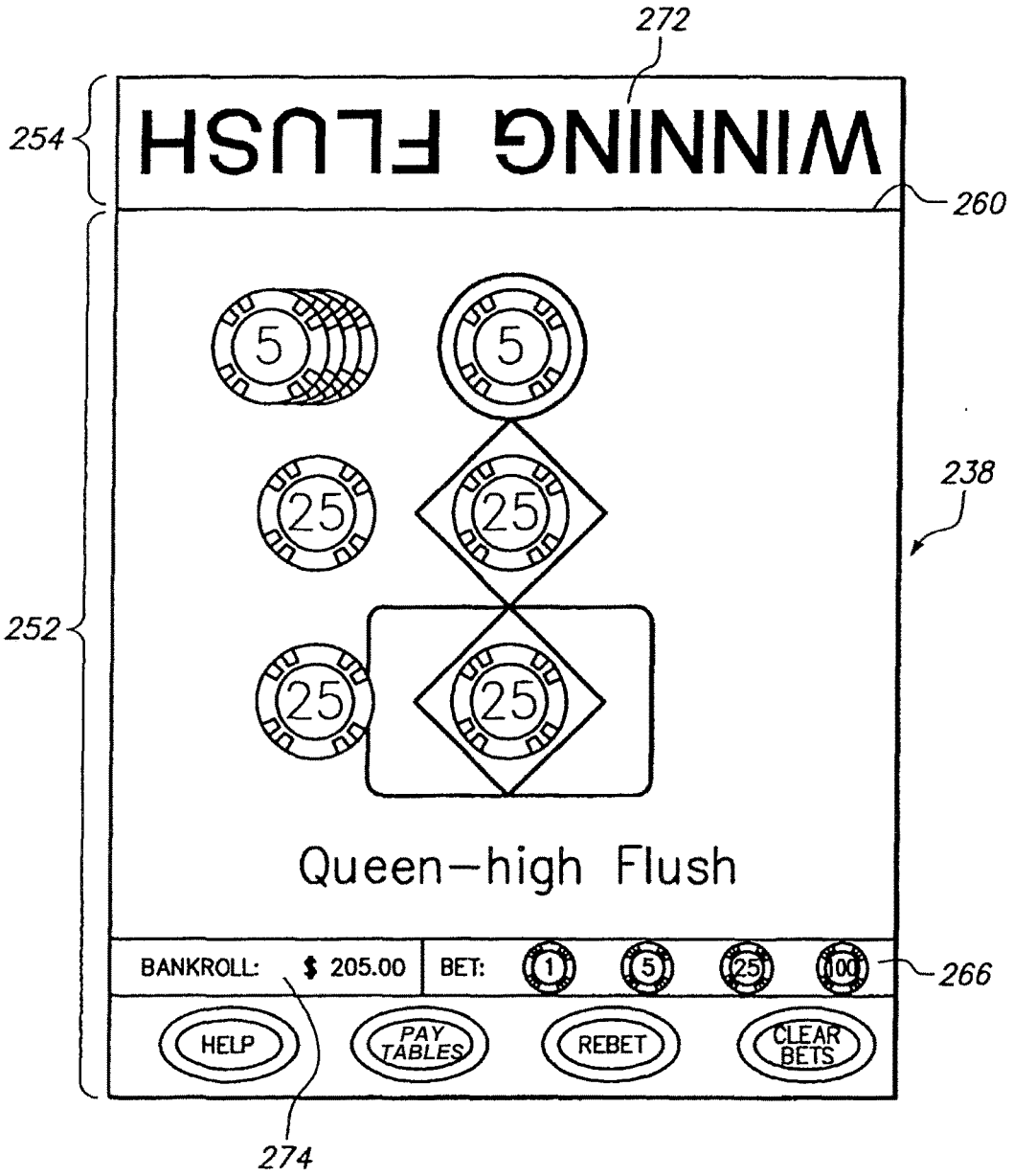
FIG. 15 illustrates an exemplary player display, with game play outcome information displayed in the dealer area of the display.

In a third mode, as illustrated in FIG. 15, the dealer area 254 of the player display 238 is capable of displaying game outcome information 272 to the dealer. The information 272 in this mode is oriented for view by the dealer. In the first mode, the game name 258 (FIG. 13) designation is shown in an orientation viewable by the player.

The information displayed to the dealer in area 254 is used by the dealer to administer game play. Payouts are preferably made automatically by the system and electronically credited to a credit meter or bankroll area 274 of the player display 238. The information also is useful for the dealer to react positively to the player win and encourage the player to re-bet the winnings, maintaining the ambiance of a live table game experience.

In a fourth mode, the dealer area 254 display is touchscreen enabled, providing the dealer with a means for inputting play information, such as concluding the play of a hand, activating a player display to request player commands, deactivating the player display, indicating the close of wagering, or other activities such as setting and rearranging hands, discarding cards, or delivering additional cards.

In the game of pai gow poker, for example, it might be necessary to display player cards on the dealer area 254 of the display. In the game of pai gow poker, the player's seven cards might be displayed in dealer area 254, and the dealer might be instructed to "SET HANDS" for the player. In some embodiments, the player may set his or her own hand. In other embodiments, the player may ask the dealer for assistance. Yet other games may require the dealer to set the player hand. The dealer would either touch the five cards that define the high hand or the two cards that define the low hand. In one embodiment, the dealer can touch and drag cards to group them in the desired manner. In other embodiments, touching the cards defining one hand rearranges the cards on the display into two set hands. The player must then arrange the physical cards to match the dealer instructions.

The touchscreen is further enabled to allow the dealer to touch and drag cards between hands, in the event that the dealer determines that the dealer's setting of the hand does not comply with the "house way." When the dealer area 254 is being used to instruct the dealer, the text is preferably inverted such that the information can be understood by the dealer. When the dealer area 254 is used to provide information to the player, the information is preferably oriented so that the player can readily understand the information. In one exemplary form of the invention, a separation line 260 is provided to divide the two display areas.

An essential feature of the chipless gaming table is a player display 238 with at least one touchscreen control panel overlay or control panel. The overlay preferably extends over the entire surface of the display. The display may be pressure sensitive, heat sensitive, moisture sensitive, conductive, or use any other known technologies to input decisions. In other examples of the invention, the touchscreen controls cover only a portion of the display. The touchscreen controls are configured to provide a first area 252, also referred to herein as the player area, for the player to make game decisions and to obtain information on how to play the game. As with the dealer area 254, the player area 252, in some preferred embodiments, is multi-functional.

Referring back to FIG. 14, a preferred player display 238 includes a player area 252. This player area 252 is used to display game information as well as to display player controls and bankroll information. Exemplary displays include electronic buttons, for example, help 276, pay tables 278, re-bet 280, and clear bets 282 buttons. The "help" button 276 activates the display of a separate help screen (not shown) that provides game rules and could offer strategic advice to the player on wagering and other game play decisions. The "pay tables" button 278 activates a screen that displays the pay table or tables showing winning combinations and corresponding payout odds for the base game and/or a side bet wager or wagers. The "rebet" button 280 allows a player to make the same size wager as made in the previous hand. The "clear bets" button 282 resets the display so that the player can make a new wager.

The control panel includes a bankroll indicator 274, showing the total number of credits the player has available for play, and a virtual chip area 266, displaying the various denominations of virtual chips 268 that can be wagered in the game. Preferably, the graphics within the virtual chip area 266 contain an accurate account of the amount of the bankroll displayed in area 274, less the wagers in play, for example, the $25.00 wager in wager area 270, the $25.00 wager in wager or "ante" area 284, and the $5.00 wager in wager area 286.

The player makes a wager by touching the virtual chip 268 he wishes to wager. He then touches the wager or "ante" area 284 indicating the location of the wager. In other embodiments, the virtual chip 268 is touched then dragged to the desired wagering location. Bets can be increased by touching the wager area 284 multiple times, once per chip. Wagers can be modified up until game play commences by touching the wager and dragging the virtual chip 268 back to the virtual chip tray 266. At the conclusion of play, payouts may be displayed by showing virtual chips "paid out" next to the betting areas, and the bankroll meter 274 is incremented with the appropriate credits. An alphanumeric "WIN" indication (e.g., "WINNING FLUSH," shown in FIG. 15) may also pop up in the dealer area 254 of the player display 238.

As noted, a preferred method of practice of the present technology is for the dealer information display segment 254 or the player section 252 of the video display screen 238 or both segments to be provided by picture-in-picture technology, whether in analog or digital format. Circuitry and processing support systems enabling this picture-in-picture format and picture-on-picture format are known in the video monitor and electronic imaging art, such as in U.S. Patent Publication No. 2008/0037628 to McDonald, et al.; U.S. Patent Publication No. 2007/0275762 to Aaltone, et al.; U.S. Patent Publication No. 2007/0256111 to Medford; and U.S. Patent Publication No. 2004/0003395 to Srinivas, et al.

Game outcome information may be displayed on community display 250 (FIG. 12).

Different communication and control relationships can exist between player input systems, game controllers, casino computers, databases, and data storage media within a single casino or multiple casinos. The relationships are known within the communication-information technologies field as "master-slave" systems, thin client systems, client server systems, and blended systems. The blended system is understood to be a system that is not fully master-slave (wherein a single dominant computer gives orders/commands to a slave subordinate computer or processor), not purely an input system (e.g., buttons only, cash input, and information signals only, without substantive commands being sent, and the like), nor a completely or substantially coequal system (peer-to-peer) wherein data processing and commands may be performed by multiple systems (multiple computers) with defined regions of control and authority. These differing relationships are contemplated by the present invention. In one exemplary form, the graphics functions are managed by the player processor, and all other functions are managed by the game CPU.

The individual components provided for functionality at each position (e.g., the slave, servant, coequal, or master functionality) are not limited to specific manufacturers of formats, but may be used according to general performance requirements. It is not even necessary that identical computing formats (MAC, PC, Linux, etc.) be used throughout the system, as long as there is an appropriate I/O communication link and language/format conversion between components. Further discussion of the nature of the various components, including definitions therefore, will be helpful.

Flash memory (sometimes called "flash RAM") is a type of constantly powered nonvolatile memory that can be erased and reprogrammed in units of memory called blocks. It is a variation of electrically erasable programmable read-only memory (EEPROM) that, unlike flash memory, is erased and rewritten at the byte level, which is slower than flash memory updating. Flash memory is often used to hold control code such as the basic input/output system (BIOS) in a personal computer. When BIOS needs to be changed (rewritten), the flash memory can be written to in block (rather than byte) sizes, making it easy to update. On the other hand, flash memory is not useful as random access memory (RAM) because RAM needs to be addressable at the byte (not the block) level. Flash memory gets its name because the microchip is organized so that a section of memory cells are erased in a single action or "flash." The erasure is caused by Fowler-Nordheim tunneling in which electrons pierce through a thin dielectric material to remove an electronic charge from a floating gate associated with each memory cell. Intel offers a form of flash memory that holds two bits (rather than one) in each memory cell, thus doubling the capacity of memory without a corresponding increase in price. Flash memory is non-volatile computer memory that can be electrically erased and reprogrammed. It is a technology that is primarily used in memory cards, and USB flash drives (thumb drives, handy drives, memory sticks, flash sticks, jump drives, currency sensors, optical sensors, credit entries, and other signal generators) for general storage and transfer of data between computers and other digital products. It is often considered a specific type of EEPROM (electrically erasable programmable read-only memory) that is erased and programmed in large blocks; in early flash, the entire chip had to be erased at once. Flash memory has also gained popularity in the game console market, where it is often used instead of EEPROMs or battery-powered SRAM for game save data.

The phrase "non-volatile" means that it does not need power to maintain the information stored in the chip. In addition, flash memory offers fast read access times (although not as fast as volatile DRAM memory used for main memory in PCs) and better kinetic shock resistance than hard disks. These characteristics explain the popularity of flash memory in portable devices. Another feature of flash memory is that, when packaged in a "memory card," it is enormously durable, being able to withstand intense pressure, extremes of temperature, and immersion in water. Although technically a type of EEPROM, the term "EEPROM" is generally used to refer specifically to non-flash EEPROM, which is erasable in small blocks, typically bytes. Because erase cycles are slow, the large block sizes used in flash memory erasing give it a significant speed advantage over old-style EEPROM when writing large amounts of data. Non-volatile memory, nonvolatile memory (NVM), or non-volatile storage, is computer memory that can retain the stored information even when not powered. Examples of non-volatile memory include read-only memory (ROM), flash memory, most types of magnetic computer storage devices (e.g., hard disks, floppy disk drives, and magnetic tape), and optical disc drives. Nonvolatile memory is typically used for the task of secondary storage or long-term persistent storage. The most widely used form of primary storage today is a volatile form of random access memory (RAM), meaning that when the computer is shut down, anything contained in RAM is lost. Flash memory may also be provided in chips, field-programmable gate arrays (FPGAs), ASICs, and Magnetic RAM (MRAM). The latter would allow for computers that could be turned on and off almost instantly, bypassing the slow startup and shutdown sequence.

The "chipless table" format and architecture described herein comprises generic concepts and specific disclosure of components and subcomponents useful in the practice of the present technology. It should be appreciated at all times that equivalents, alternatives, and additional components, functions, and processes may be used within the system without deviating from the enabled and claimed technology of this invention.

The game information (which is preferably for multiple games) is configurable and is set up during the initial installation of the table and may be switched from game to game at each table. It is from this setup that the game information is selected so that the graphics on the player displays 238, dealer area 252, pit display 294, and table display 288 provide the correct information regarding the game in play. It is the capability of changing individual types of game events (e.g., from blackjack to a poker-style game, then to baccarat) at a table that enables, or even requires that the generic felt of the playing surface 232 is free of any permanent game-specific printing. There may be separate monitors (not shown) that enable display of game names, game rules, and pay tables for individual games, or under table back-lighting that may project such information display on the table.

Using the pit display 294, the game is selected by casino personnel and communicated to the table controller 244 via a touchscreen control on the pit display 294. The table controller 244 (and/or a central pit controller) sends out the appropriate graphics to each of the player screens and table signs to begin game play.

One example for the basic procedure for game play is:

1. A player buys in with cash, chips, tickets, electronic access to an account, credit card, marker, or the like.
2. The dealer adds credits to a player position using the dealer console.
3. Wagers are made electronically using the touchscreen controls at each individual player position. Touchscreens may be of any convenient size considering ease of viewability by players, space limitations on the table, and ergonomics, and, for example, may be between about 4 inches and 15 inches at each player position (diagonal measurement).
4. All initial wagering (e.g., antes, initial bonus wagers, initial jackpot wagers, initial mandatory wagers) is stopped when the first card or hand is delivered. Delivery may be from the shoe or shuffler. This stopping may be affected by a signal from the shoe or shuffler (to the game processor/table computer) that actual play of a round of the underlying game has been made. Subsequent wagers (such as splitting events, double downs, secondary wagers, play wagers, etc.) may be subsequently made in a controlled manner by the system. Player decisions are inputted by players using the player input areas, and instructions are provided in alphanumeric or graphical form to the dealer on the dealer portion of the player display.
5. The underlying game is played as normal, with physical cards being provided and all wagers and resolutions of wagers being made on the electronic wagering system. (Note: The touchscreen procedures and graphics for each game usually will be different, and table play for each game will be provided, controlled, enabled, and directed by the game processor/table computer.)
6. Upon hand or game completion, wager reconciliation is initiated either by the dealer (e.g., specifically inputting a signal or command by button or dealer area of the player display using touchscreen or other input) or automatically by the system (which has determined by card-reading events that a round or game has ended) and is reflected as an increase, no change (push) or decrease in the bankroll on the player's screen.
7. When a player leaves the table, credits are removed from the player position through the dealer console, and the credits are paid out with chips, tickets, cash, or credits transferred to a player account from the dealer console.

In one embodiment, the table has reporting functionality, such as reports that are specific to the table and recorded by pit personnel on a regular basis. This data can be accessed on the pit display touchscreen on a (for example, 15-inch pit display 294 (FIG. 12)). The raw data from the chipless gaming table 230 can be packaged and sent to a central pit or house computer for analysis (of player ratings, dealer efficiency, table handle, etc.).

Dealer Console

An example of properties that would be available in a dealer console touchscreen 252 should be able to perform the following actions:

Buy in and cash out players on the table;

Notify the dealer if a player chooses to cash out;

Enable and disable player touchscreens;

Move credits if a player chooses to change seats;

Allows the dealer to log-in/log-out on the table;

Inform the dealer (initially, only informing is desirable, although the alert may be triggered and waited for until after players further wagering) if the dealer has a blackjack (i.e., "no peek" function), a hand that does not qualify, or other condition that would alter the game outcome; and Reconcile the wagers when the hand is complete when the dealer presses a "reconcile" button on the touchscreen.

The CPU/Game Controller/Table Computer 244 (FIG. 12)

Preferred functions of the game controller 244 are as follows:

Store game information;

Manage the player terminals;

Control the one-way or two-way (e.g., 10-inch to 20-inch) table sign 250 with pay tables, game information, progressive amount, etc.;

Control the pit sign with game setup options, table statistics, etc.;

Control the player buy-in process through communication with the player input system;

Control player cash-out process through communication with the player input system;

Record wagers made at the start of a game;

Prevent betting after the first card is dealt (except as additional wagers are allowed during play of various game, but then only limited wagers and specific wagers);

Receive card and or hand information from the shoe, shuffler, overhead camera imaging system, or table-mounted card reader;

Evaluate player bets;
Automatically pay the wins and collect losing bets;
Enable specifically identified betting after the hand for the player terminal has been resolved;
Interface to the optional jackpot system; and
Provide touchscreen resolution of events and games.

Player Displays 238 (FIG. 12)

The player touchscreen (or PTS) is (for example, a 10.5-inch) a touchscreen with an attached processor board. The player uses the PTS to make wagers, to communicate game actions to the dealer, and to record game play events. The top section of the touchscreen (relative to the player) is split, and graphics are reversed at certain stages of use for the dealer to know what action the player is taking and to receive instructions to take action requested by the player. Certain considerations should be made on the design to include the following:

Placement of the displays in the table should be flush (or very close), and the touchscreen bezel should be minimal. This will minimize card edges snagging and getting stuck when dealt and pulled towards the player. It is actually better to have the screen slightly elevated above the plane of the table top (e.g., the felt cover or other surface) as it is easier to slide cards along a raised edge then to lift the cards out of a depression.

Other desirable features are listed below:
Easy replacement of player terminals when broken;
Graphics must be easy to understand for the patrons; and
Help screens should be available and accessible on demand.

The functions of the player touchscreen include:
Providing the player with his or her bankroll amount;
Allowing the player to wager, increase, or decrease a wager;
Allowing the player to repeat the previous wager with a single button press;
Notifying the dealer if the player would like to cash out;
Recording player actions during the game (for example—hit, stand, double down, etc., make additional wagers, call for additional cards, fold, etc.); and
Reporting player actions to the dealer via the split screen; and Touchscreen resolution—all alphanumerics should be easily readable by players and dealers at a distance of three meters or more.

Table Display 250 (FIG. 12)

The table display 250 is a two part system comprising a front player display 288 and the rear pit display 294. These parts are combined in one embodiment into a double-sided display, vertically mounted above the surface of the table. That is, two screens are placed back-to-back, one facing the pit and one facing the player. The LCD screen (or other display screen) facing the table is used for player information. It may or may not be a touchscreen. The pit display in one example of the invention is a touchscreen that allows for pit interaction with the table to include game selection and pit reports. In other embodiments, the pit can input information via a keyboard that communicates with the game controller or directly with the pit display 294.

An exemplary 15-inch communal player display 250 is pole mounted into the table, viewable by players on the table in the manner shown in FIG. 12. This display may be used to provide information that normally would have been printed on the felt (game, table rules, pay tables, game name, casino logo, legal markings, etc.). It also can include information on a progressive jackpot, casino advertising, or any information that the casino may want to provide to a player.

The table display functionality shall include, for example:
Providing game name and applicable rules;
Displaying game pay tables;
Providing progressive jackpot information;
Identifying winning players; and/or
Allowing casino advertising.

The LCD (or other display) resolution should be easily readable by players and dealers at a distance of three meters or more.

Pit Display 294 (FIG. 12)

In one embodiment, the 15-inch pit touchscreen is mounted facing the pit. The display is used to provide information to a pit supervisor regarding the table. The touchscreen allows for initial set up, game selection, and pit reports. Alternatively, data is input through a keyboard in the pit and is displayed on the display.

The pit display functionality includes, for example:
Selecting initial game set up and game options;
Selecting games;
Opening and closing the table;
Setting table minimum and maximum bet limits; and/or
Interfacing to the optional jackpot system.

Card-Handling Device 246 (FIG. 12)

The shoe/shuffler or card delivery system 246 must be able to provide the function of electronically identifying the cards that are delivered. Examples of suitable card delivery systems are described in U.S. Patent Publication 2006/0279040, published Dec. 14, 2006, titled "Manual Dealing Shoe With Card Feed Limiter"; U.S. Patent Publication 2008/0303210, application Ser. No. 11/810,864, filed Jun. 6, 2007, titled "Apparatus, System, Method, and Computer-Readable Medium for Casino Card Handling with Multiple Hand Recall Feature"; and U.S. Pat. No. 7,374,170, issued May 30, 2008, titled "Playing Card Dealing Shoe With Automated Internal Card Feeding and Card Reading." The disclosures of these publications are incorporated by reference in their entireties. The card delivery device may read cards internally and then deliver cards one at a time or in sets of cards, with the identity of the individual cards (and all cards in sets), or may read cards one by one, as they are removed from the delivery system, and forward that information to the table game controller. With card reading technology on the table combined with the wagers and player actions, the game can be re-created for player analysis and game tracking.

In games that are dealt from a single deck of cards and in groups of fixed numbers of cards, it is advantageous to use a shuffler that reads the rank and suit of cards, forms random groups of cards within the device, then retains the hand composition information for further use. Most specialty poker games could be played using this type of shuffler. Forming random hands within the shuffler and then delivering hands of known composition to the players and to the dealer when required would allow for easy detection of card switching and other cheating methods. One such shuffler is marketed under the name i-DEAL® by Shuffle Master, Inc., and is the subject of U.S. Patent Publication 2008/0303210.

The card delivery system selected in some embodiments have a "chipless" mode in which the unit accepts commands from the game controller through an I/O port, such as a USB port, cable entry, pinned connection, or, preferably, a wireless network access.

The card delivery system functionality for the chipless table may include:
Communicating to the game controller when the first hand or card is pulled for the game controller to lock out the bets on the player touchscreens;

Accurately recognizing the rank and suit for each card; and/or

Reporting the card information to the game controller.

Other systems, such as the overhead card-imaging systems described above or table-mounted card readers are other exemplary sources of card rank and/or suit information.

Gaming Table Requirements

When installing the product, the system preferably provides a tabletop structure with all electronics embedded within a layered tabletop. This layered tabletop can be built in a factory and installed on a pre-existing support surface, such as conventional "H" table legs or a crescent-shaped cabinet. The system preferably includes instructions for mounting the tabletop onto the support structure. There may be instances when the player display is mounted closer to the dealer. In this embodiment, all system components are essentially the same as described above, except for the placement of the player displays on the table. Moving the displays closer to the dealer is desirable when the dealer must input information into the dealer portion of the screen, such as when the dealer sets a pai gow poker hand, or indicates the conclusion of play for a particular player, for example.

The tabletop should be covered with plain felt (no printing indicative of only a single game). Printing may be present identifying the casino, the CTGS manufacturer, sponsors, events, and other information that is not specific to a single game or multiple games. This will allow the operator to quickly change the game in play without changing the table felt.

Systems of the present invention allow for drinks at the table. Electronic systems of the present invention possess a high degree of water resistance against spilled drink penetration around the edges of the monitors. This may be done by sealant, and/or tight mounting that does not allow liquid penetration. Grooves receiving the screen and overlapping tight-fitting elements will reduce liquid penetration and enable wiping to prevent rapid, significant penetration and damage. It is desirable to use player screen/processor units that are liquid tight.

Consideration should be given to how quickly a player touchscreen can be replaced in the event that one is damaged. The use of modular screens, with modular processors can assist in effecting this benefit.

Optional Multi-Table Pit Computer

The pit computer gathers data from multiple tables and stores the information in a database for use by the casino for player analysis, table accounting, etc.

The functionality might include, for example:

Hosting the database for the table; and

Optionally, hosting the jackpot system.

Player/Dealer ID Card-Reading System

The card reader is an add-on that may be used by the dealer, the pit, and/or players. Dealers and pit personnel may use cards to authorize play at the table. The card reader can also be used to accept player tracking cards.

Felt Backlight Display (Optional)

Back lighting under the felt may be used to define the areas of the table where cards should be placed by the dealer.

Hardware Interface

The hardware interface used in communication linkage of the components may be any architecture used to interconnect two pieces of equipment. It includes the design of the plug and socket; the type, number, and purpose of the wires; and the electrical signals that are passed across them. USB, FIREWIRE®, ETHERNET®, parallel, and serial ports, as well as COMPACTFLASH® cards, PCI cards, and PC Cards are all examples of hardware interfaces (devices connecting to other devices). As noted, wireless communication between elements is generally preferred.

Software Interfaces

Any functional and established software interface may be used, such as selecting those from amongst the ANSI Standard, ISO/IEC Standards, and IEEE Standards. There are well published lists of these standards and include at least:

IEEE Standards

IEEE 694-1994: Microprocessor Assembly Language.

Defines a common assembly language intended to be used for a variety of microprocessor architectures.

IEEE 695-1990: Microprocessor Relocatable Software Formats.

Defines a common format for object files in a small computer environment. The purpose is to enable program construction from modules written in different languages and processed by different compilers.

IEEE 754-1990: Binary Floating Point Arithmetic.

Defines binary formats and basic operations for floating-point arithmetic. This is commonly referred to as "IEEE floating point" and has become widely adopted in new system implementations.

IEEE 770-1983 (ANSI X3.97): Pascal Computer Programming Language.

Provides a formal specification for Pascal, the first language standardized by IEEE.

IEEE 854-1994: Radix and Format Independent Floating Point Arithmetic.

Specifies alternate floating point arithmetic formats and operations for implementations that do not necessarily use base 2.

IEEE 855-1990: Microprocessor Operating System Interfaces (MOSI).

Defines a standard OS/program interface (API) for small computers, commonly known as MOSI. Compared to the better-known POSIX (1003), MOSI is less detailed but spans a broader range of target systems. Includes language bindings for FORTRAN, C, Ada, Pascal, and others as appendices. Also ISO DIS 11685.2.

IEEE 1003.1-1990: POSIX Part 1: System API (Language Independent).

Defines a standard OS/program interface, commonly known as POSIX, for UNIX-like systems. Includes language bindings for C, only, and also ISO 9945-1.

IEEE 1003.1b-1993: Real-Time and Related System API.

Specifies additions to the POSIX API to support real-time requirements.

IEEE 1003.2-1992: Shell and Utility Application Interface.

Defines functionality for a UNIX-like shell (command handler) and associated tools.

IEEE 1003.9-1992: Fortran 77 Language Bindings to POSIX.

Specifies the syntax for accessing the functionality of a POSIX interface using the FORTRAN language.

IEEE 1224-1993: OSI Abstract Data Manipulation API.

Specifies an API for Abstract Data Manipulation using the OSI (7-layer) Communication Systems model.

IEEE 1224.1: OSI X-400 Based Electronic Messaging API.

Specifies an API for Electronic Messaging Services using the OSI model.

IEEE 1224.2-1993: Information Technology: Directory Services API.

Specifies an API for Directory Services using the OSI model. IEEE 1275-1994: Boot Firmware.

Defines elements of program functionality to be used in boot (startup) programs in read-only memory.

IEEE 1327-1993: OSI Abstract Data Manipulation C Language Binding.

Specifies a C Language Binding for IEEE 1224.

IEEE 1224.1: Information Technology: X-400 Based Electronic Messaging C Language Binding.

Specifies a C Language Binding for IEEE 1224.1.

IEEE 1224.2-1993: Directory Services C Language Binding.

Specifies a C Language Binding for IEEE 1224.2.

IEEE 1596-1992: Scalable Coherent Interface.

Specifies a physical interconnection scheme for multiprocessors, including aspects that affect their programming Computer-related (Information Processing) standards sponsored by the American National Standards Institute (ANSI) are developed primarily by the Accredited Standards Committee X3. These standards are designated X3.nnn.

ANSI Standards

ANSI X3.4-1986: 7-bit American National Standard Code for Information Interchange.

Base definition for the widely used character code known as ASCII.

ANSI X3.9-1978(R1989): Programming Language FORTRAN.

Third revision of the first and most venerable programming language standard. The 1978 version, called FORTRAN-77, is widely implemented. The 1989 version, called FORTRAN-90, is not yet as popular.

ANSI X3.23-1985: Programming Language COBOL.

The widely-used business-oriented language.

ANSI X3.23a-1989: Programming Languages—Intrinsic Function Module for COBOL.

Extensions to the COBOL standard.

ANSI X3.28-1976(R1986): Procedures for the Use of the Communications Control Characters of American National Standards Code for Information Interchange in Specified Data Communication Links.

Provides interpretations for the ASCII communication control characters.

ANSI X3.30-1985(R1991): Representation for Calendar Date and Ordinal Date for Information Interchange.

Specifies how date information should be represented for data exchange.

ANSI X3.41-1990: Code Extension Techniques for Use with the 7-byte Coded Character Set of ASCII.

Specifies how the ASCII code may be extended.

ANSI X3.43-1986: Representations of Local Time of Day for Information Interchange.

Specifies how time information should be represented for information interchange.

ANSI X3.51-1986: Representations of Universal Time, Local Time Differentials, and United States Time Zone References for Information Interchange.

Specifies additional time-related information representations.

ANSI X3.53-1976(R1987): Programming Language PL/I.

Specification for the PL/I language, used primarily on IBM systems.

ANSI X3.64-1979(R1990): Additional Controls for Use with the American National Standard Code for Information Interchange.

Specifies a large collection of ASCII extensions to control display and printer functionality. In practice a small set of screen editing and cursor positioning codes have been widely adapted; these are supported by so-called "ANSI terminals."

ANSI X3.74-1987: Programming Language PL/I, General Purpose Subset.

A stripped-down version of the big language.

ANSI X3.113-1987: Programming Language Full BASIC.

Specification for the BASIC programming language, which has existed in a vast range of different versions.

ANSI X3.113a-1989: Modules and Individual Character Input for Full Basic.

Some extensions to X3.113.

ANSI X3.124-1985: Graphical Kernel System (GKS) Functional Description.

Specifications for a hardware-independent method for specifying graphic elements.

ANSI X3.124.1-1985: Graphical Kernel System (GKS) FORTRAN Binding.

How to use GKS with the FORTRAN language.

ANSI X3.124.2-1988: Graphical Kernel System (GKS) Pascal Binding.

How to use GKS with the Pascal language.

ANSI X3.124.3-1989: Graphical Kernel System (GKS) Ada Binding.

How to use GKS with the Ada language.

ANSI X3.159-1989: Programming Language C.

Formal Specifications for the C Language (ANSI C).

ISO/IEC Standards

These are formation processing standards under the sponsorship of the International Organization for Standardization (ISO) and have generally been developed by the Technical Committee TC97. Standards related to microprocessors under the sponsorship of IEC have been developed by the Technical subcommittee SC47B. Since about 1990, information processing standards for both organizations have been managed by the Joint Technical Committee JTC1.

ISO 646-1983: ISO 7-bit coded character set for information interchange.

ISO version of the ASCII character set with (alas) minor differences.

ISO 1538-1984: Programming Language ALGOL 60.

One language that was never standardized in the U.S.

ISO 2022-1982: ISO 7-bit and 8-bit coded character sets. Code extension techniques.

Techniques for extending the codes of ISO 646 and ISO 4873.

ISO 4873-1979: 8-bit coded character set for information interchange.

An extended version of ISO 646 that encodes 8 bits to provide an additional 128 codes.

ISO 6429-1983: ISO 7-bit and 8-bit coded character sets.

Additional control functions for character-imaging devices.

ISO 7498-1984: Open Systems Interconnection—Basic Reference Model.

Extended display and printer controls for ISO 646 and ISO 4873.

Communication Interfaces

As noted earlier, the communication interfaces may be client-server, master-slave, peer-to-peer, and blended systems, with different relationships among the various processors and PCUs as designed into the system.

Any allowable (jurisdictionally, by state, county, and/or federal) laws and regulations may be used as the communication standards, with FTP or HTTP standards being the most common and acceptable, but not exclusive, formats used. In each of the computers and processors used, each may include a display and a number of input buttons, or touchscreen functions, and combinations of these with wired or wireless communication links to enable a player to initiate actions or make responses as required during a game. In a game in which the player is playing against the house, the player's hand is displayed face up on the screen as it is dealt, and the house hand may be shown face down on the screen. Touch "buttons" can be provided on the screen in addition to or instead of the physical buttons. In a further non-limiting configuration, one or more of the players can be located in separate locations, and the player terminals or hand-held devices or player screens in rooms can be connected to the controller via communication links (e.g., hardwired or wireless). Standard protocols, software, hardware, and processor languages may be used in these communication links, without any known limitations. There are hundreds of available computer languages that may be used, among the more common being Ada, Algol, APL, awk, Basic, C, C++, Cobol, Delphi, Eiffel, Euphoria, Forth, Fortran, HTML, Icon, JAVA®, JACASCRIPT®,Lisp, Logo, MATHEMATICA®, MATLAB®, Miranda, Modula-2, OBERON®, Pascal, Perl, PL/I, Prolog, Python, Rexx, SAS, Scheme, sed, Simula, Smalltalk, Snobol, SQL, Visual Basic, Visual C++, and XML.

Any commercial processor may be used as a single processor, one of serial processors, or one of a parallel set of processors in the system. Examples of commercial processors include, but are not limited to MERCED™, PENTIUM®, PENTIUM® II, XEON®, CELERON®, PENTIUM PRO™, EFFICEON™, Athlon, AMD, and the like.

Display screens may be segment display screens, analog display screens, digital display screens, CRTs, LED screens, plasma screens, liquid crystal diode screens, and the like.

Exemplary player displays are 15-inch 1024×768 pixels or dots. The touchscreen overlay in one example is preferably about 15-inch 1024×768 pixels or dots. The size and resolution of a preferred dealer display and touchscreen is 6.5 inches and from 512 to 1024 pixels per line (or higher definition). The screen resolution is a matter of cost and image quality resolution.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A method for playing a commissionless pai gow poker card game with a house advantage, the method comprising:

providing a gaming table comprising a felt surface having a plurality of player positions and a dealer position, the felt surface illustrated, at each of the plurality of player positions, with a high hand location designated for a five-card player hand, a low hand location designated for a two-card player hand, and a base game wager spot;

the dealer providing at the gaming table randomized cards from a deck of cards, the deck of cards comprising 52 physical cards and one physical joker card;

the dealer accepting, from a player associated with a player position of the plurality of player positions, one or more wagers, including a base game wager in the form of one or more chips placed on the base game wager spot of the player position, without collecting a commission;

the dealer distributing cards from the randomized cards, comprising moving seven physical playing cards to the player position for the player associated with the player position to create player cards and moving seven physical playing cards to the dealer position to create dealer cards;

the dealer arranging or allowing the player to arrange the player cards to create a five-card player hand occupying the high hand location and a two-card player hand occupying the low hand location, a rank of the five-card player hand exceeding a rank of the two-card player hand;

the dealer arranging the dealer cards to create, on the felt surface of the gaming table, a five-card dealer hand and a two-card dealer hand, a rank of the five-card dealer hand exceeding a rank of the two-card dealer hand;

the dealer evaluating a set of cards selected from the group consisting of the five-card dealer hand and the two-card dealer hand to determine whether a rank of the set of cards meets or is lower than a predetermined rank;

if the dealer evaluating the set of cards determines that the rank of the set of cards meets or is lower than the predetermined rank, the dealer paying out a payout, in the form of at least one additional chip on or proximate the base game wager spot, at a 1:2 payout rate without collecting the commission;

if the dealer evaluating the set of cards determines that the rank of the set of cards exceeds the predetermined rank, the dealer comparing the rank of the five-card dealer hand to the rank of the five-card player hand on the high hand location and comparing the rank of the two-card dealer hand to the rank of the two-card player hand on the low hand location;

if the dealer comparing determines that the rank of the five-card dealer hand exceeds the rank of the five-card player hand on the high hand location and that the rank of the two-card dealer hand exceeds the rank of the two-card player hand on the low hand location, the dealer collecting the base game wager by removing the base game wager in the form of the one or more chips from the base game wager spot;

if the dealer comparing determines that the rank of the five-card dealer hand is lower than the rank of the five-card player hand on the high hand location and that the rank of the two-card dealer hand is lower than the rank of the two-card player hand on the low hand location, the dealer paying out a winning payout, in the form of one or more additional chips on or proximate the base game wager spot, without collecting the commission;

if the dealer comparing determines that the rank of the five-card dealer hand exceeds the rank of the five-card player hand on the high hand location and that the rank of the two-card dealer hand is lower than the rank of the two-card player hand on the low hand location, the dealer declaring the game a push and returning the base game wager to the player, by leaving the base game wager in the form of the one or more chips on the base game wager spot, without collecting the commission; and if the dealer comparing determines that the rank of the five-card dealer hand is lower than the rank of the five-card player hand on the high hand location and that the rank of the two-card dealer hand exceeds the rank of the two-card player hand on the low hand location, the dealer declaring the game a push and returning the base game wager to the player, by leaving the base game wager in the form of the one or more chips on the base game wager spot, without collecting the commission.

2. The method of claim 1:

wherein providing a gaming table comprises providing the gaming table comprising the felt surface having the plurality of player positions and the dealer position, the felt surface illustrated with, at each of the plurality of player positions, the high hand location, the low hand location, the base game wager spot, and further illustrated with a bonus wager spot; and the method further comprising:

the dealer accepting, from the player associated with the player position, a bonus event wager, in the form of one or more other chips placed on the bonus wager spot;

the dealer evaluating a bonus event to determine whether the bonus event results in one of a losing outcome and a winning outcome, evaluating the bonus event comprising considering a value of one or more distributed physical playing cards;

if the dealer evaluating the bonus event determines that the bonus event results in the losing outcome, the dealer collecting the bonus event wager by removing the bonus event wager in the form of the one or more other chips from the bonus wager spot; and if the dealer evaluating the bonus event determines that the bonus event results in the winning outcome, the dealer paying a bonus event payout in the form of at least one additional chip on or proximate the bonus wager spot.

3. The method of claim 1, wherein the dealer providing at the gaming table randomized cards from a deck of cards comprises the dealer providing the deck of cards comprising the 52 physical cards and the one physical joker card, the one physical joker card treated as a wild card with a rank of an ace unless the one physical joker card is arranged in a straight or flush wherein the one physical joker card is treated as a wild card with a rank of a king, a queen, or a jack.

4. The method of claim 1, further comprising:

if the dealer comparing determines that the rank of the five-card dealer hand equals the rank of the five-card player hand on the high hand location, the dealer designating the five-card dealer hand as a dealer winning five-card hand; and if the dealer comparing determines that the rank of the two-card dealer hand equals the rank of the two-card player hand on the low hand location, the dealer designating the two-card dealer hand as a dealer winning two-card hand.

5. The method of claim 1, wherein the dealer arranging or allowing the player to arrange the player cards to create a five-card player hand occupying the high hand location and a two-card player hand occupying the low hand location comprises, after receiving an arrangement request from the player, the dealer arranging according to a house way the player cards to create the five-card player hand on the high hand location and the two-card player hand on the low hand location.

6. The method of claim 1, wherein the dealer evaluating a set of cards to determine whether a rank of the set of cards meets or is lower than a predetermined rank comprises the dealer evaluating the set of cards to determine whether the rank of the set of cards meets or is lower than a predetermined rank selected from the group consisting of: a king high, a queen high, an ace high, a low pair, and a pair of twos.

7. The method of claim 1, wherein the dealer evaluating a set of cards to determine whether a rank of the set of cards meets or is lower than a predetermined rank comprises the dealer evaluating the set of cards to determine whether the rank of the set of cards meets or is lower than a predetermined rank of at least a king high.

8. The method of claim 1, wherein the dealer paying out a winning payout, in the form of one or more additional chips on or proximate the base game wager spot, without collecting the commission comprises the dealer providing on or proximate the base game wager spot the one or more additional chips at a rate of 1:1 without collecting the commission.

9. The method of claim 1, wherein providing a gaming table comprises providing the gaming table comprising the felt surface illustrated with the high hand location, the low hand location, the base game wager spot, and further marked to indicate the predetermined rank.

10. A method for playing a commissionless pai gow poker card game with a house advantage, comprising:

providing at least a tabletop of a gaming table, the tabletop comprising a gaming surface defining a dealer position opposite one or more player positions, the gaming surface imprinted to define, at each of the one or more player positions, a high hand location, a low hand location, and a base game wager spot between the low hand location and the dealer position, the tabletop further comprising a dealer chip tray proximate the dealer position;

providing at the gaming table a shuffling device;

providing a deck of physical cards to the shuffling device, the deck of the physical cards comprising at least a deck of 52 physical cards;

a dealer accepting one or more wagers from a player without collecting a commission, the one or more wagers comprising a base game wager in the form of at least one chip placed on the base game wager spot of a player position, of the one or more player positions, associated with the player;

the dealer distributing physical playing cards received from the shuffling device, comprising the dealer distributing at least six physical playing cards to the player position associated with the player to create player cards and distributing at least six physical playing cards to the dealer position to create dealer cards;

the dealer arranging or allowing the player to arrange the player cards into a high player hand on the high hand location and a low player hand on the low hand location, a rank of the high player hand exceeding a rank of the low player hand;

the dealer arranging the dealer cards into a high dealer hand and a low dealer hand, a rank of the high dealer hand exceeding a rank of the low dealer hand;

before or after the dealer arranging the dealer cards, the dealer evaluating the dealer cards to determine whether the dealer cards meet or exceed a qualifying rank displayed at the gaming table;

if the dealer evaluating determines that the dealer cards do not meet or exceed the qualifying rank displayed at the gaming table, the dealer paying a payout at a payout rate greater than 1:10 and less than 1:1 by transferring from the dealer chip tray and to or near the base game wager spot at least one additional chip, without collecting the commission;

if the dealer evaluating determines that the dealer cards do meet or exceed the qualifying rank displayed at the gaming table, the dealer comparing the rank of the high dealer hand to the rank of the high player hand on the high hand location and comparing the rank of the low dealer hand to the rank of the low player hand on the low hand location;

if the dealer comparing determines that the rank of the high dealer hand exceeds the rank of the high player hand on the high hand location and that the rank of the low dealer hand exceeds the rank of the low player hand on the low hand location, the dealer collecting the base game wager by moving the base game wager in the form of the at least one chip from the base game wager spot to the dealer chip tray; and if the dealer comparing determines that the rank of the high dealer hand is lower than the rank of the high player hand on the high hand location and that the rank of the low dealer hand is lower than the rank of the low player hand on the low hand location, the dealer paying a winning payout at a rate at least 1:1, by transferring from the dealer chip tray and to or near the base game wager spot at least one other chip of a collective value at least equal to a value of the at least one chip of the base game wager previously placed on the base game wager spot, without collecting the commission.

11. The method of claim 10, further comprising:

if the dealer comparing determines that the rank of the high dealer hand exceeds the rank of the high player hand on the high hand location and that the rank of the low dealer hand is lower than the rank of the low player hand on the low hand location, the dealer declaring the game a push and returning the base game wager to the player by leaving the base game wager in the form of the at least one chip on the base game wager spot without collecting the commission; and if the dealer comparing determines that the rank of the high dealer hand is lower than the rank of the high player hand on the high hand location and that the rank of the low dealer hand exceeds the rank of the low player hand on the low hand location, the dealer declaring the game a push and returning the wager to the player by leaving the base game wager in the form of the at least one chip on the base game wager spot without collecting the commission.

12. The method of claim 10, wherein the dealer evaluating the dealer cards to determine whether the dealer cards meet or exceed a qualifying rank displayed at the gaming table comprises the dealer evaluating the dealer cards to determine whether the dealer cards meet or exceed a rank of at least king high imprinted on the surface of the gaming table.

13. The method of claim 10:

wherein providing at least a tabletop of a gaming table comprises providing the tabletop comprising the gaming surface imprinted to define, at the each of the one or more player positions, the high hand location, the low hand location, the base game wager spot, and a bonus wager spot adjacent the base game wager spot;

the method further comprising:

the dealer accepting from the player a bonus event wager in the form of at least one other chip placed on the bonus wager spot of the player position associated with the player;

the dealer evaluating a bonus event to determine whether the bonus event results in one of a losing outcome and a winning outcome, evaluating the bonus event comprising the dealer considering a value of one or more distributed physical playing cards;

if the dealer evaluating the bonus event determines that the bonus event results in the losing outcome, the dealer collecting the bonus event wager, comprising transferring the at least one other chip from the bonus wager spot to the dealer chip tray; and if the dealer evaluating the bonus event determines that the bonus event results in the winning outcome, the dealer paying a bonus event payout, comprising transferring from the dealer chip tray at least one additional chip to or near the bonus wager spot.

14. The method of claim 13, wherein the dealer paying a bonus event payout further comprises the dealer paying a progressive jackpot based at least in part on progressive jackpot information displayed on a communal player display pole mounted to the gaming table.

15. The method of claim 10, wherein providing a deck of physical cards to the shuffling device comprises the dealer providing to the shuffling device the deck of physical cards comprising the deck of 52 physical cards and a joker designated as a wild card and assigned a rank of ace unless the joker is arranged in a straight or flush wherein the joker card is assigned a rank of a king, a queen, or a jack.

16. The method of claim 10, wherein:

the dealer distributing at least six physical playing cards to the player position associated with the player comprises the dealer distributing seven physical playing cards from the shuffling device to the player position; and the dealer distributing at least six physical playing cards to the dealer position comprises the dealer distributing seven physical playing cards from the shuffling device to the dealer position.

17. The method of claim 10, wherein the dealer providing a deck of physical cards to the shuffling device comprises the dealer providing to an automatic shuffler device the deck of physical cards comprising the at least the deck of 52 physical cards and further comprising a physical joker card.

18. The method of claim 10, wherein the dealer arranging or allowing the player to arrange the player cards comprises the dealer allowing the player to move some of the player cards into the high hand location and to move others of the player cards into the low hand location at the player position associated with the player.

19. The method of claim 10, wherein the dealer arranging or allowing the player to arrange the player cards comprises the dealer moving some of the player cards into the high hand location and moving others of the player cards into the low hand location at the player position associated with the player.

20. The method of claim 10, wherein, if the dealer evaluating determines that the dealer cards do not meet or exceed the qualifying rank displayed at the gaming table, the dealer paying a payout comprises paying a payout at a payout rate of 1:2 by transferring from the dealer chip tray to or near the base game wager spot at least one additional chip having a collective value of half a value of the at least one chip for the base game wager previously placed on the base game wager spot, without collecting the commission.

21. The method of claim 10, wherein the dealer evaluating the dealer cards to determine whether the dealer cards meet or exceed a qualifying rank displayed at the gaming table follows the dealer arranging the dealer cards into a high dealer hand and a low dealer hand.

22. The method of claim 21, wherein the dealer evaluating the dealer cards to determine whether the dealer cards meet or exceed a qualifying rank displayed at the gaming table comprises the dealer evaluating the high dealer hand to determine whether the high dealer hand meets or exceeds the qualifying rank displayed at the gaming table.

* * * * *